US012063998B2

(12) United States Patent
Peters et al.

(10) Patent No.: US 12,063,998 B2
(45) Date of Patent: Aug. 20, 2024

(54) WAISTBAND CONSTRUCTION AND METHODS FOR PRODUCING SAME

(71) Applicant: The Gap, Inc., Albuquerque, NM (US)

(72) Inventors: Jeannette Peters, San Pablo, CA (US); Helena Monteiro, Oakland, CA (US)

(73) Assignee: The Gap, Inc., San Francisco, CA (US)

( * ) Notice: Subject to any disclaimer, the term of this patent is extended or adjusted under 35 U.S.C. 154(b) by 0 days.

(21) Appl. No.: 17/717,881

(22) Filed: Apr. 11, 2022

(65) Prior Publication Data

US 2022/0232918 A1 Jul. 28, 2022

Related U.S. Application Data

(62) Division of application No. 16/355,538, filed on Mar. 15, 2019, now Pat. No. 11,297,889.

(60) Provisional application No. 62/648,838, filed on Mar. 27, 2018.

(51) Int. Cl.

| | |
|---|---|
| ***A41F 9/00*** | (2006.01) |
| ***A41B 9/14*** | (2006.01) |
| ***A41D 1/06*** | (2006.01) |
| ***A41D 1/14*** | (2006.01) |
| ***A41D 27/00*** | (2006.01) |
| ***A41F 9/02*** | (2006.01) |

(52) U.S. Cl.

CPC ..... *A41F 9/02* (2013.01); *A41D 1/06* (2013.01); *A41D 1/14* (2013.01); *A41D 27/00* (2013.01); *A41F 9/00* (2013.01); *A41B 9/14* (2013.01); *A41D 2300/22* (2013.01)

(58) Field of Classification Search

CPC ..... A41B 9/14; A41F 9/00; A41F 9/02; A41F 9/025

See application file for complete search history.

(56) References Cited

U.S. PATENT DOCUMENTS

| | | | |
|---|---|---|---|
| 3,078,469 | A | 2/1963 | Lynam |
| 3,427,661 | A | 2/1969 | Navasky |
| 3,735,424 | A | 5/1973 | Maggio |
| 3,868,729 | A | 3/1975 | Lynam |
| 4,549,317 | A | 10/1985 | D'Ambrosia |
| 4,970,728 | A | 11/1990 | D'Ambrosia |
| 5,464,488 | A | 11/1995 | Servin |
| 5,483,702 | A | 1/1996 | D'Ambrosia |
| 9,021,615 | B2 | 5/2015 | Cockram |
| 9,295,293 | B2 | 3/2016 | Rosenhaus |

(Continued)

FOREIGN PATENT DOCUMENTS

WO WO 2017-111639 A1 6/2017

OTHER PUBLICATIONS

Appleby, Chelsea Katen, "Development of Fabric Seaming for Clothing Using Ultrasonic Sealing Technique," *Senior Honors Theses*, 229, Eastern Michigan University, Apr. 2009; 21 pgs.

(Continued)

*Primary Examiner* — Sally Haden

(74) *Attorney, Agent, or Firm* — Morgan, Lewis & Bockius LLP

(57) ABSTRACT

A waistband of an article of clothing including an inner fabric layer, and an outer fabric layer integrally formed or coupled with the inner fabric layer. The waistband also includes a mesh layer disposed between the inner and outer fabric layers. The waistband further a first adhesive layer and a second adhesive layer disposed between the mesh layer and the inner fabric layer, and configured to couple the mesh layer with the inner fabric layer.

4 Claims, 40 Drawing Sheets

(56) References Cited

U.S. PATENT DOCUMENTS

| | | | |
|---|---|---|---|
| 10,709,187 | B2 | 7/2020 | Harris et al. |
| 2008/0078012 | A1 | 4/2008 | Mario |
| 2010/0180360 | A1 | 7/2010 | DiSanto et al. |
| 2010/0275344 | A1 | 11/2010 | Demarest et al. |
| 2013/0007947 | A1 | 1/2013 | Moore et al. |
| 2014/0005010 | A1 | 1/2014 | Kaminsky |
| 2017/0258159 | A1 | 9/2017 | Moore |
| 2018/0110275 | A1 | 4/2018 | Moffa |
| 2019/0053557 | A1 | 2/2019 | Moore |

OTHER PUBLICATIONS

Thorp, Virginia, "Performance Apparel Markets," *Textiles Intelligence Limited*, United Kingdom, No. 16, 1st quarter 2006.

WAISTBAND CONSTRUCTION AND METHODS FOR PRODUCING SAME

CROSS-REFERENCE TO RELATED APPLICATIONS

The present application is a divisional of U.S. patent application Ser. No. 16/355,538, entitled "Waistband Construction and Methods for Producing Same," filed Mar. 15, 2019, which claims priority to U.S. Provisional Patent Application No. 62/648,838, entitled "Waistband Construction and Methods for Producing Same," filed Mar. 27, 2018, each of which is incorporated herein in its entirety for all purposes.

FIELD

The present invention generally relates to waistbands for use in articles of clothing and methods for producing waistbands.

BACKGROUND

Many existing waistbands are not comfortable to wear. They are usually bulky and not supportive. When worn, the tops of existing waistbands are often folded over.

Given the current state of the art, there remains a need for waistbands that address the abovementioned issues.

The information disclosed in this Background section is provided for an understanding of the general background of the invention and is not an acknowledgement or suggestion that this information forms part of the prior art already known to a person skilled in the art.

SUMMARY

The present invention provides a waistband of an article of clothing that is comfortable to wear, non-bulky and supportive.

In an aspect, the present invention provides a waistband of an article of clothing. The waistband includes an inner fabric layer and an outer fabric layer. The outer fabric layer is integrally formed or coupled with the inner fabric layer. Moreover, the waistband includes a mesh layer disposed between the inner and outer fabric layers. Furthermore, the waistband includes a first adhesive layer and a second adhesive layer disposed longitudinally between the mesh layer and the inner fabric layer. The first adhesive layer and the second adhesive layer are collectively configured to couple the mesh layer with the inner fabric layer. Furthermore, an upper region of the waistband includes the inner fabric layer, the first adhesive layer, the second adhesive layer, the mesh layer and the outer fabric layer, thereby overlaying a first portion of the first adhesive layer and a second portion of the second adhesive layer. A middle region of the waistband includes the inner fabric layer, the second adhesive layer, the mesh layer and the outer fabric layer. Additionally, a lower region of the waistband comprises the inner fabric layer, the mesh layer and the outer fabric layer. The inner fabric layer includes a first fabric and a first portion of a second fabric. The outer fabric layer includes a second portion of the second fabric. The first fabric includes a first portion having a first edge. Furthermore, the first portion of the second fabric includes a second edge. The first edge of the first portion of the first fabric and the second edge of the first portion of the second fabric are joined with each other and form a stitch-free seam.

In some embodiments, the first adhesive layer is disposed between the inner fabric layer and the second adhesive layer.

In some embodiments, the first adhesive layer is disposed between the second adhesive layer and the mesh layer.

In some embodiments, when worn, the inner fabric layer faces toward a wearer's body and the outer fabric layer faces away from the wearer's body.

In some embodiments, the outer fabric layer extends to a portion or an entire length of the waistband.

In some embodiments, the waistband further includes one or more first adhesive strips disposed between the first fabric and the mesh layer. The one or more first adhesive strips is configured to couple the mesh layer with the first fabric and to define a border of a first pocket. Furthermore, the first fabric further includes a first flap. The first flap is adjacent the first edge of the first portion of the first fabric, the first flap is extended from the first portion of the first fabric, and the first flap is folded onto the first portion of the first fabric. Additionally, the second fabric further includes a second flap. The second flap is adjacent the second edge of the first portion of the second fabric, and the second flap is extended from the first portion of the second fabric. Moreover, the first flap of the first fabric and the second flap of the second fabric collectively define an opening of the first pocket.

In some embodiments, the first flap of the first fabric is adhered to the first portion of the first fabric by a third adhesive layer.

In some embodiments, the opening of the first pocket is substantially aligned with the stitch-free seam.

In some embodiments, the first and second bar tacks are disposed respectively at first and second ends of a folding line of the first flap of the first fabric and configured to reinforce the first flap of the first fabric. Further, each of the first and second bar tacks extends at least through the first fabric to the mesh layer.

In some embodiments, the one or more adhesive strips includes a straight adhesive strip, a slant adhesive strip, a curved adhesive strip, or a combination thereof.

In some embodiments, the opening of the first pocket is bordered by a reinforcing material.

In some embodiments, the second adhesive layer is wider than the first adhesive layer.

In some embodiments, the first fabric further includes one or more openings. Each opening in the one or more openings of the first fabric defines an opening of a second pocket in one or more second pockets. Moreover, the waistband further includes, for each respective second pocket in the one or more second pockets, one or more second adhesive strips disposed between the first fabric and the mesh layer. The one or more second adhesive strips is configured to couple the mesh layer with the first fabric and to define a border of the respective second pocket in the one or more second pockets.

In some embodiments, the second adhesive layer includes a third adhesive strip disposed at the upper region of the waistband and a fourth adhesive strip disposed at the middle region of the waistband. Furthermore, the fourth adhesive strip of the second adhesive layer is spaced apart from the third adhesive strip of the second adhesive layer, or spaced apart from the first adhesive layer and the third adhesive strip of the second adhesive layer, to form a tunnel for receiving a drawstring.

In some embodiments, the waistband further includes a drawstring disposed in the tunnel.

In some embodiments, the first fabric further includes a pair of holes. A portion of the drawstring is exposed to an exterior of the tunnel through the pair of holes.

Another aspect of the present disclosure is directed to providing a waistband. The waistband includes an inner fabric layer and an outer fabric layer that is integrally formed or coupled with the inner fabric layer. The waistband further includes a mesh layer disposed between the inner and outer fabric layers. Additionally, the waistband includes a first adhesive strip and a second adhesive disposed between the mesh layer and the inner fabric layer. The first adhesive strip and the second adhesive strip are collectively configured to couple the mesh layer with the inner fabric layer. Moreover, the first adhesive strip and the second adhesive strip are spaced apart with a distance in between to form a tunnel for receiving a drawstring.

In some embodiments, the first adhesive strip is disposed at an upper region of the waistband, and the second adhesive strip is disposed at a middle region of the waistband. Furthermore, the first adhesive strip has an elastic modulus greater than that of the second adhesive strip.

In some embodiments, the inner fabric layer includes a first fabric and a first portion of a second fabric. Moreover, the outer fabric layer includes a second portion of the second fabric. The first fabric a first edge. Further, the first portion of the second fabric is folded with respect to the second portion of the second fabric. Moreover, the first portion of the second fabric includes a second edge. The first edge of the first fabric and the second edge of the first portion of the second fabric are joined with each other and form a stitch-free seam.

In some embodiments, the first adhesive strip is overlaid over the stitch-free seam to reinforce the stitch-free seam.

BRIEF DESCRIPTION OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention can be embodied in different forms and thus should not be construed as being limited to the embodiments set forth herein.

DETAILED DESCRIPTION

Figure 1A:
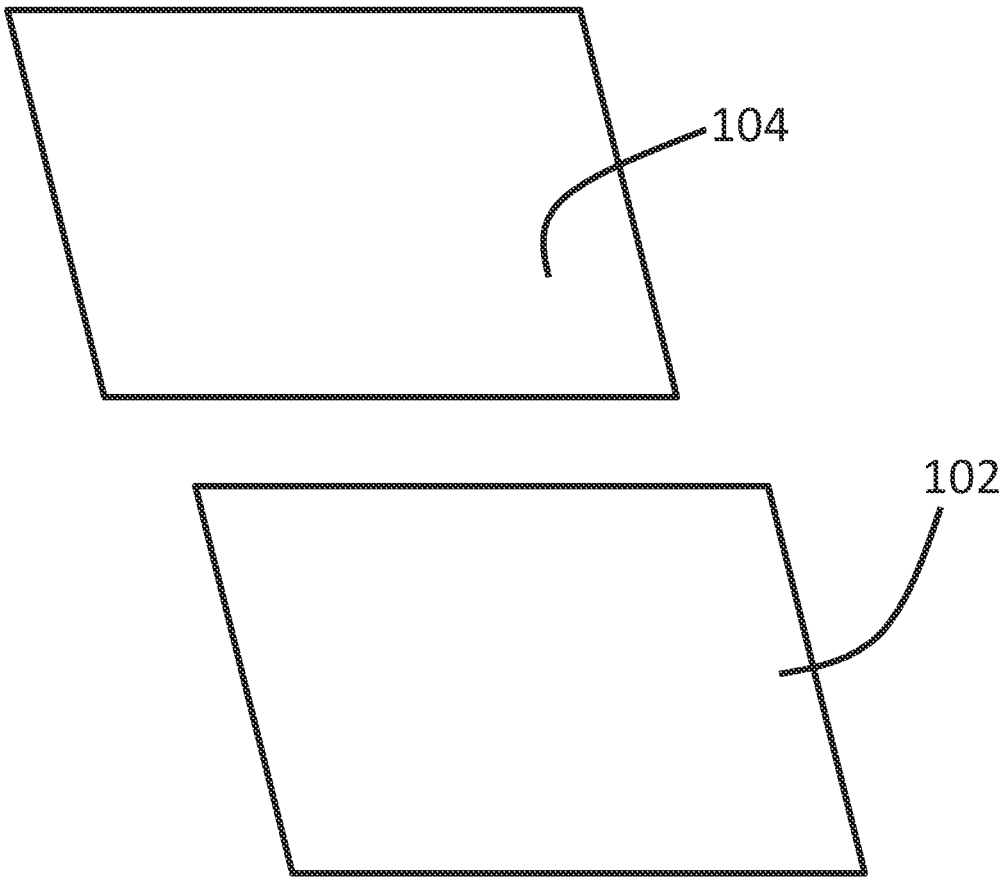
FIGS. 1A-1I are schematic views illustrating exemplary steps for constructing an exemplary waistband in accordance with an exemplary embodiment of the present invention.

Reference will now be made in detail to implementations of the exemplary embodiments of the present invention as illustrated in the accompanying drawings. The same reference indicators will be used throughout the drawings and the following detailed description to refer to the same or like parts. Those of ordinary skill in the art will understand that the following detailed description is illustrative only and is not intended to be in any way limiting. Other embodiments of the present invention will readily suggest themselves to such skilled persons having benefit of this disclosure.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Embodiments of the present disclosure are described in the context of waistbands. In general, a waistband of the present disclosure is of a multiple layer structure with enhanced elastic strength at the top or an upper region of the waistband. Such a multiple layer structure provides a comfortable, non-bulky yet supportive waistband. It also prevents the top or the upper region of the waistband from folding over. In various embodiments, a waistband of the present disclosure is constructed such that the upper region of the waistband is elastically stronger than the middle region of the waistband, and the middle region of the waistband is elastically stronger than the lower region of the waistband. In some embodiments, a waistband of the present disclosure includes a mesh layer and one or more adhesive layers to enhance the elasticity of these regions.

The terminology used herein is for the purpose of describing particular implementations only and is not intended to be limiting of the claims. As used herein, the term "upper region" refers to a portion of the waistband at or adjacent the top of the waistband. The term "middle region" refers to a portion of the waistband relative to the upper region and below the upper region of the waistband. The term "lower region" refers to a portion of the waistband relative to the middle region, and below the middle region of the waistband. It should be understood that the terms "upper", "middle", or "lower", and etc. are used to describe features of the exemplary embodiments with reference to the positions of such features as displayed in the figures. The middle region of a waistband can be but not necessarily have to be a central portion of the waistband. Similarly, the lower region of a waistband can be but not necessarily have to be at or adjacent the bottom of the waistband.

As used herein, the singular forms "a", "an" and "the" are intended to include the plural forms as well, unless the context clearly indicates otherwise.

As used herein, the terms—"waistband" and "waistband construction"—are used interchangeably. As used herein, the terms—an "inner fabric layer" of a waistband and an "inside portion" of a waistband—are used interchangeably. As used herein, the terms—an "outer fabric layer" of a waistband and an "outside portion" of a waistband—are used interchangeably. As used herein, the terms—"mesh" and "mesh layer"—are used interchangeably.

In some embodiments, the present invention provides a waistband construction for use in articles of clothing. The articles of clothing may be configured to be worn from the waist or hips of a person and cover at least a portion of the person's lower body, for example, trousers, pants, tights, leggings, shorts, skirts, skorts, breeches, underpants, and the like. Waistband constructions according to embodiments of the present invention may be suitable for use in athletic or performance apparel, for example, yoga pants, running shorts, cycling shorts, aquatic shorts, etc.

In some embodiments, a waistband construction according to the present disclosure includes a plurality of layers. In some embodiments, a waistband construction includes at least one fabric layer which forms an exterior portion of the waistband, and an internal mesh layer. In some embodiments, the fabric layer is folded, at least partially, around the internal mesh layer such that, for example, the internal mesh is sandwiched between two portions of the fabric layer. In some embodiments, the plurality of layers includes or consists of a first fabric, a second fabric, and a mesh disposed between the first fabric and the second fabric. The first fabric, for example, may form an inner portion of the waistband and the second fabric may form an outer portion of the waistband, with the mesh being sandwiched between the first fabric and the second fabric. The first fabric and the second fabric may include a stretch fabric, for example, having a two-way stretch (stretches in one direction) or four-way stretch (stretches in two directions). The first fabric and the second fabric, in some embodiments, may be made from synthetic (artificial) fibers, for example, polyester, spandex, rayon, nylon, acrylic, etc. The first fabric, in some embodiments, may be of the same or different material than the second fabric. For example, in some embodiments, the first fabric may have a same or different texture, weave, hand (feel), elasticity, and/or breathability than the second fabric. In some embodiments, the first fabric may have a different dimension (e.g., length and/or height) than the second fabric. For example, the first fabric which forms an inner portion of the waistband may have a shorter length than the second fabric which forms an outer portion of the waistband.

In some embodiments, the mesh includes a mesh fabric having a continuous pattern of fine holes. In some embodiments, the mesh is a sheer fabric that is more transparent/translucent than either the first or second fabric. The mesh, in some embodiments, includes a synthetic material (e.g., polyester, spandex, rayon, nylon, acrylic, etc.) and may have a weave that is looser or more open than either the first or second fabric. In some embodiments, the mesh is more breathable than either the first or second fabric. In some embodiments, including the mesh in the waistband may improve the fit of the waistband construction around a person's body. In some embodiments, including an internal mesh in the waistband construction causes the waistband to maintain a closer fit of the waistband against the person's waist or hip (e.g., to reduce the occurrence of a gap between the waistband and the person's body, at a back portion). In some embodiments, the internal mesh may also be configured to increase the modulus (e.g., elastic modulus) of the resulting waistband. In further embodiments, the internal mesh is used to define, at least partially, one or more storage pockets that are formed between the layers that make up the waistband. In yet additional embodiments, the mesh is used to define, at least partially, a tunnel for a drawstring that extends along a length of the waistband.

In some embodiments, some or all of the layers of the waistband construction are joined together with seams that do not require stitching or sewing (e.g., without loops of threads which pass through the different layers). Such stitch-free seams, in some embodiments, allow the waistband to have a smoother profile, a closer fit against the body, and avoid or reduce chafing. For example, in some such embodiments, the first fabric and the second fabric are, at least partially, joined together with an ultrasonic line bonded seam. In some embodiments, the mesh may be attached to the first fabric and/or the second fabric using one or more adhesive layers. Examples of the one or more adhesive layers comprise but are not limited to seam reinforcement type and polyurethane.

Figure 9:
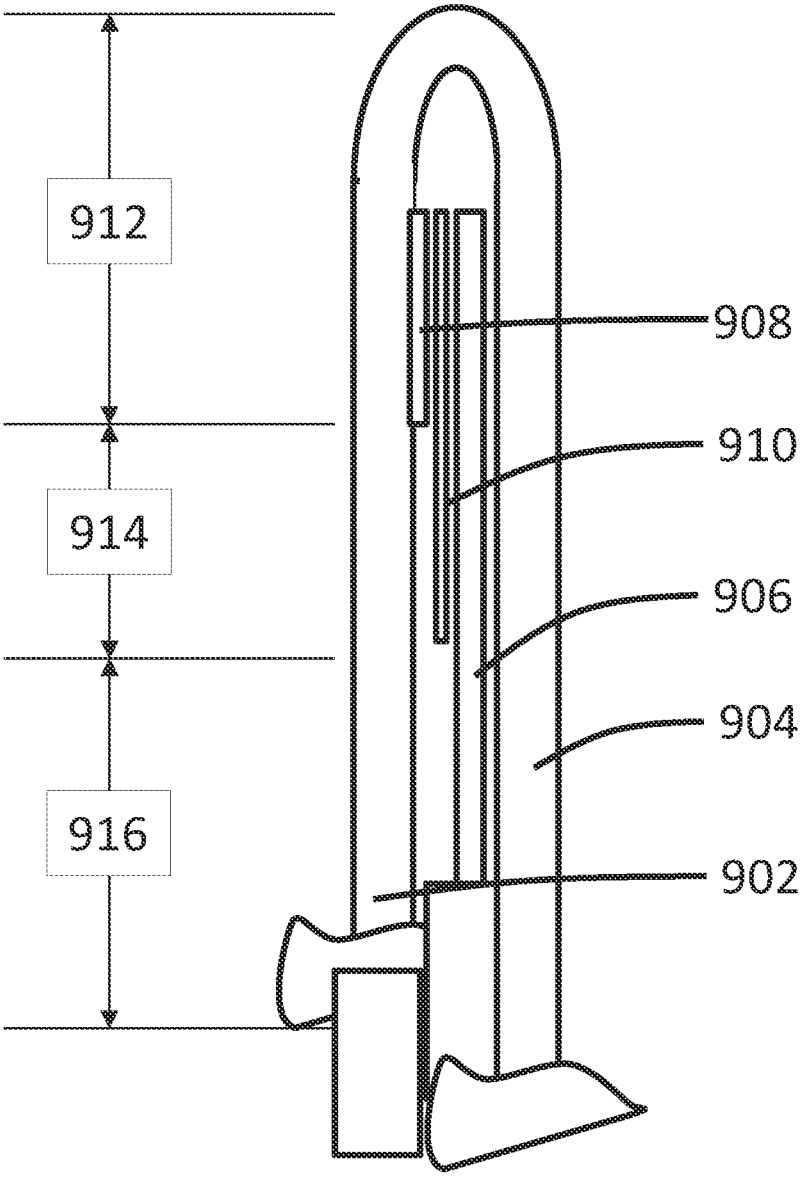
FIG. 9 is a schematic cross-sectional view illustrating a waistband in accordance with some exemplary embodiments of the present invention.

In various embodiments, a waistband of the present invention comprises inner and outer fabric layers, a mesh layer disposed between the inner and outer fabric layers, and one or more adhesive layers configured to couple the mesh layer with the inner fabric layer. For instance, by way of example, FIG. 9 illustrates an exemplary waistband comprising an inner fabric layer 902, an outer fabric layer 904, a mesh layer 906, a first adhesive layer 908 and a second adhesive layer 910.

The inner and outer fabric layers can be formed integrally with each other, for instance, being made of one piece of fabric. The inner and outer fabric layers can also be formed by coupling two or more pieces of fabric joined by one or more seams. For instance, in an embodiment, the inner and outer fabric layers are formed of two pieces of fabric joined by a stitch-free seam. When worn in a typical way, the inner fabric layer generally faces toward a wearer's body and the outer fabric layer faces away from the wearer's body.

In some embodiments, the inner and outer fabric layers have substantially the same width, e.g., the bottoms of the inner and outer layers are substantially aligned with each other. In some embodiments, the inner and outer fabric layers have different widths. For instance, in some embodiments, the outer fabric layer extends to a portion or an entire length of an article of clothing (e.g., extending all the way down a pant). In such embodiments, the waistband is invisible from the outside.

The mesh layer is disposed between the inner and outer fabric layers and is coupled to the inner layer by the first and second adhesive layers. In some cases, the mesh layer and the one or more adhesive layers are configured to enhance the elastic strength of the waistband. In many embodiments, the first adhesive layer is disposed at (constrained to) an upper region 914 of the waistband, and the second adhesive layer is disposed at (constrained to) the upper region 914 and a middle region 916 of the waistband. In such embodiments, the upper region of the waistband comprises the inner fabric layer, the first adhesive layer, the second adhesive layer, the mesh layer and the outer fabric layer. The middle region of the waistband comprises the inner fabric layer, the second adhesive layer, the mesh layer and the outer fabric layer. A lower region 916 of the waistband comprises the inner fabric layer, the mesh layer and the outer fabric layer. As such, the upper region of the waistband has an elastic modulus greater than that of the middle region of the waistband, and the middle region of the waistband has an elastic modulus greater than that of the lower region of the waistband. This provides a comfortable, supportive and elastic waistband. In some embodiments where the outer fabric layer extends to at least a portion of the article of clothing, the waistband is also invisible from the outside.

It should be noted that the first adhesive layer can be disposed between the inner fabric layer and the second adhesive layer, or between the second adhesive layer and the mesh layer. By way of example, FIG. 9 illustrates the first adhesive layer is disposed between the inner fabric layer and the second adhesive layer. Also, it should be noted that the first or second adhesive layer can fill the entire upper region or a portion of the upper region, and the second adhesive layer can fill the entire middle region or a portion of the middle region. By way of example, FIG. 9 illustrates the first and second adhesive layers fill a portion of the upper region, and the second adhesive layer fills the entire middle region of the waistband. Further, it should be noted that an adhesive layer (e.g., the first, the second, or any other adhesive layer) disclosed herein can be continuous or non-continuous. For instance, the second layer can be formed of two spatially separated adhesive strips, one disposed at the upper region and the other disposed at the middle region of the waistband. By way of example, FIG. 9 illustrates continuous first and second adhesive layers. Still, it should be noted that a layer (e.g., an adhesive layer, a mesh layer, or a fabric layer) can be one single layer or a layer with multiple sub-layers of the same material or of different materials. Still further, it should be noted that the first layer and the portion of the second layer disposed at the upper region can be one single thicker layer or one single layer of a different material having an elastic strength greater than the portion of the second layer disposed at the lower region of the waistband.

A waistband of the present disclosure can comprise additional, optional and alternative features. In many embodiments, the inner fabric layer, the first or second adhesive layer, the mesh layer, the outer fabric layer, or any combination thereof are configured to form some additional, optional and alternative features of the waistband. For instance, a waistband of the present invention can be configured to have one or more seams, one or more drawstrings, one or more pockets, or any combination thereof.

Figure 2:
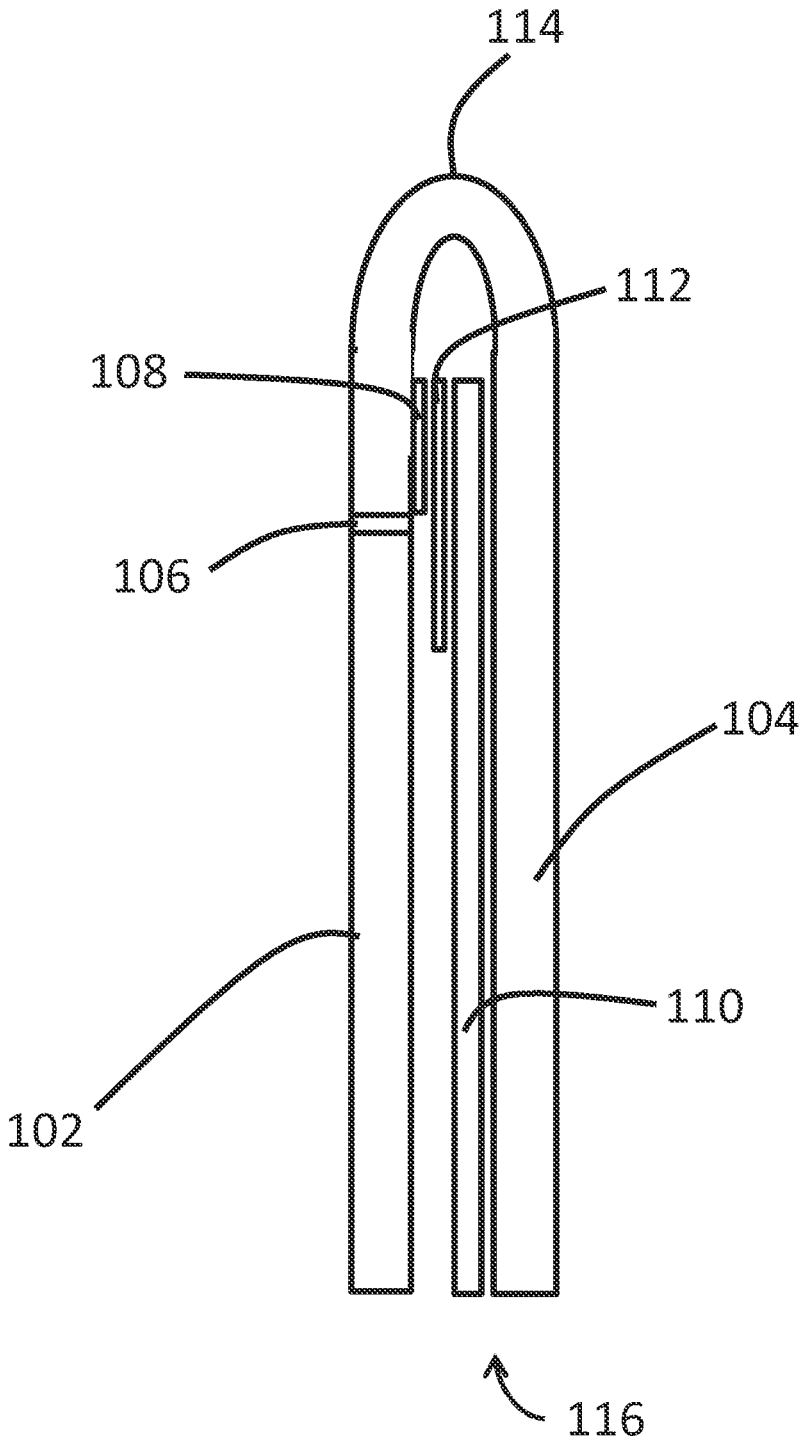
FIG. 2 is a cross-sectional view of a waistband constructed according to the steps provided in FIGS. 1A-1I taken along a plane designated by line 2-2 in FIG. 1I.

As an example, FIG. 2 illustrates an exemplary waistband with a seam 106 at the inner fabric layer. In some embodiments, the inner fabric layer comprises a first fabric 102 and a first portion of a second fabric 104, and the outer fabric layer comprises a second portion of the second fabric. The first portion of the second fabric is folded with respect to the second portion of the second fabric. The first fabric and the first portion of the second fabric are joined with each other and form a seam 106. The first and second fabrics can be made of a same material or of different materials. In some embodiments, at least one of the first and second fabrics comprises a synthetic fabric, including but not limited to polyester, spandex, rayon, nylon, and acrylic.

In some embodiments, at least one of the first and second adhesive layers is overlaid over the seam, and configured to reinforce the seam. In some embodiments, the seam is a stitch-free seam as disclosed herein. In an embodiment, the seam is an ultrasonic bonded line seam disclosed herein.

Figure 3F:
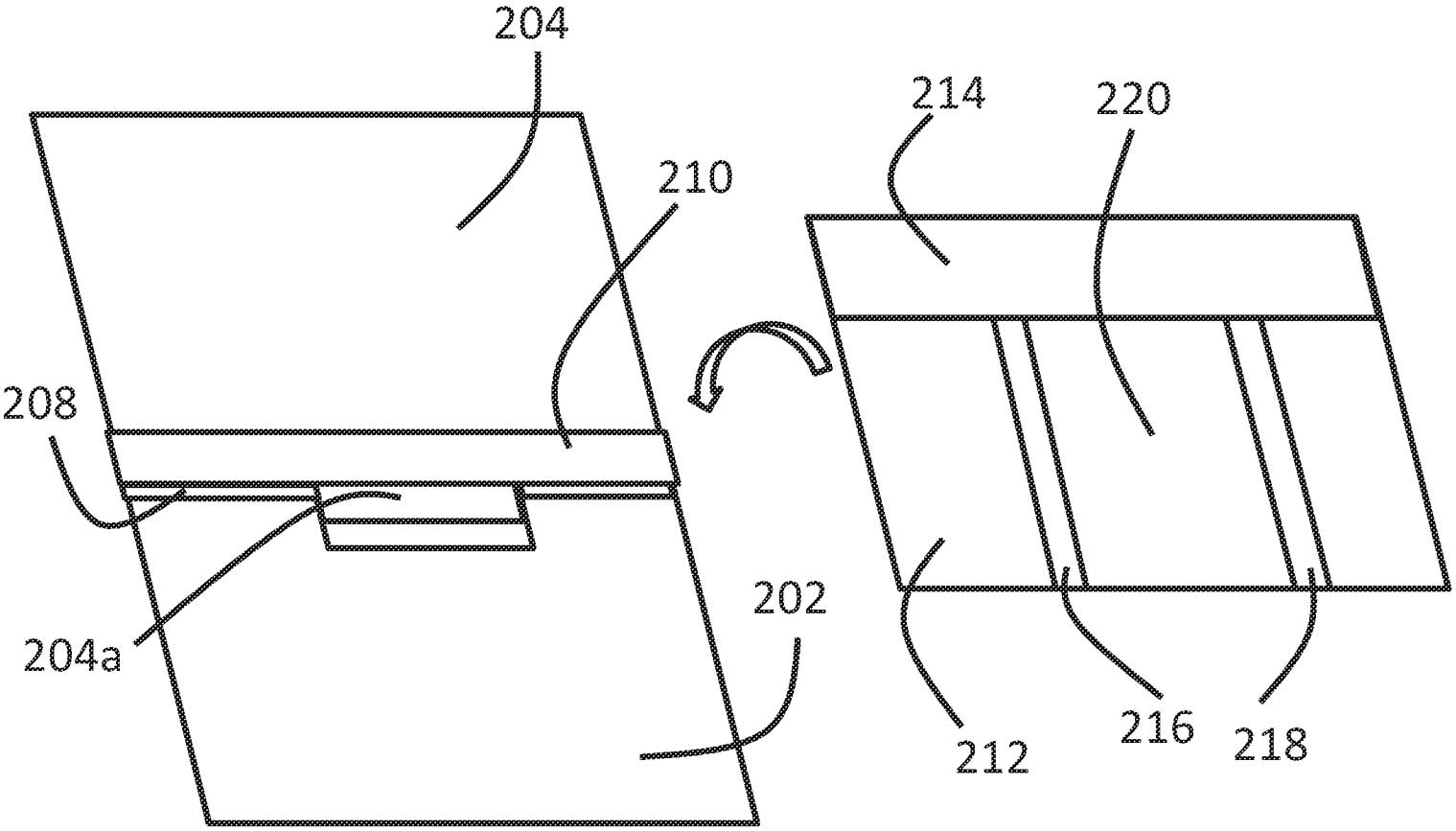
Figure 4:
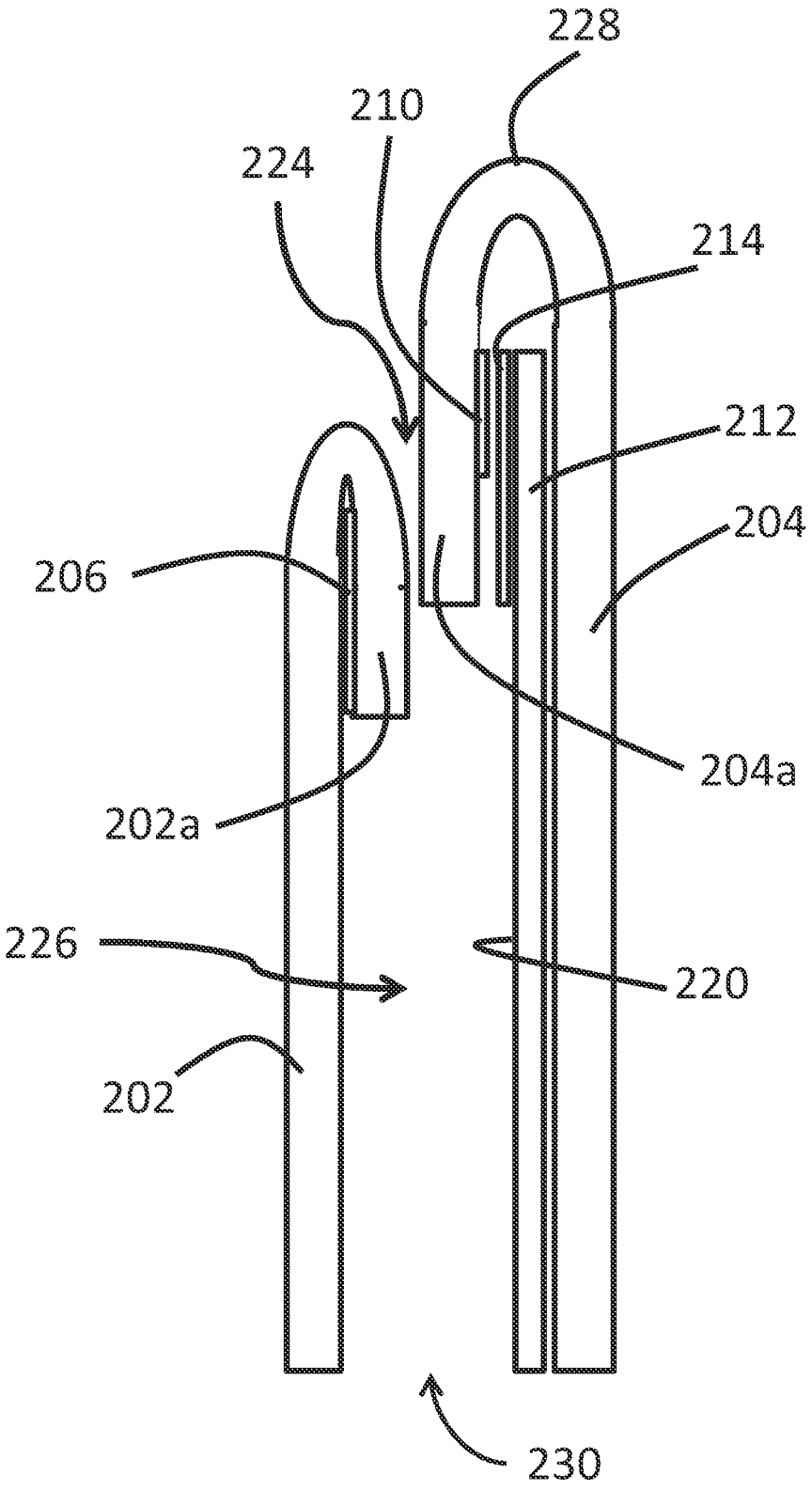
FIG. 4 is a cross-sectional view of a waistband constructed according to the steps provided in FIGS. 3A-3K taken along a plane designated by line 4-4 in FIG. 3K.

As another example, FIG. 4 illustrates an exemplary waistband with a pocket having an opening 224 and an interior space 226. The pocket can be configured with any suitable shape and any suitable size, and can be positioned at any suitable location and with any suitable orientation. In some embodiments, a waistband of the present invention comprises one or more adhesive strips, such as adhesive strips 216 and 218 in FIG. 3F, disposed between the first fabric and the mesh layer to couple the mesh layer with the first fabric. The one or more adhesive strips generally define the border of the pocket, which can have any suitable shape, size or orientation. By way of example, FIG. 3F illustrates adhesive strips 216 and 218 being substantially straight and parallel to each other. It should be noted that the one or more adhesive strips can be but not necessarily have to be parallel or perpendicular to each other. Also, it should be noted that the one or more adhesive strips can be straight, slant, or curved.

Figure 3A:
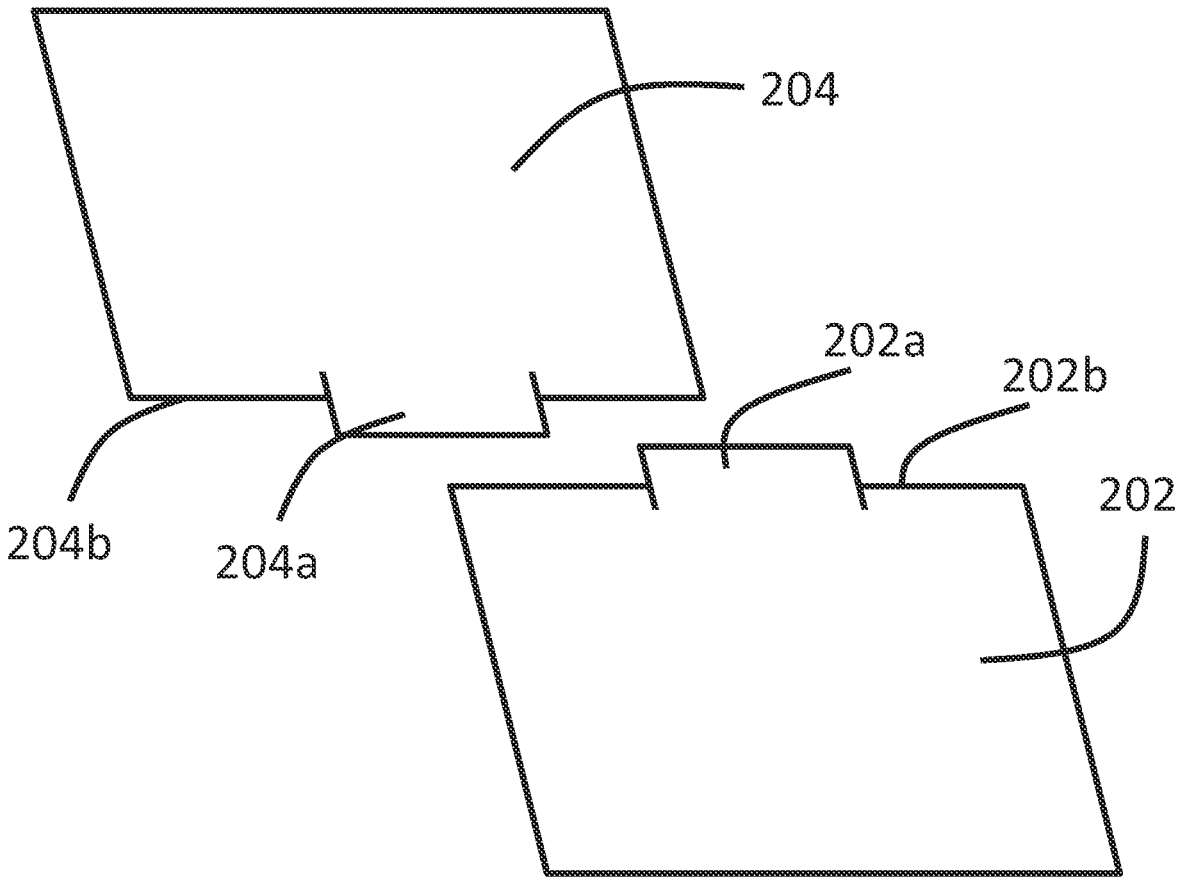
FIGS. 3A-3K are schematic views illustrating exemplary steps for constructing an exemplary waistband having an exemplary pocket in accordance with another exemplary embodiment of the present invention.
Figure 3B:
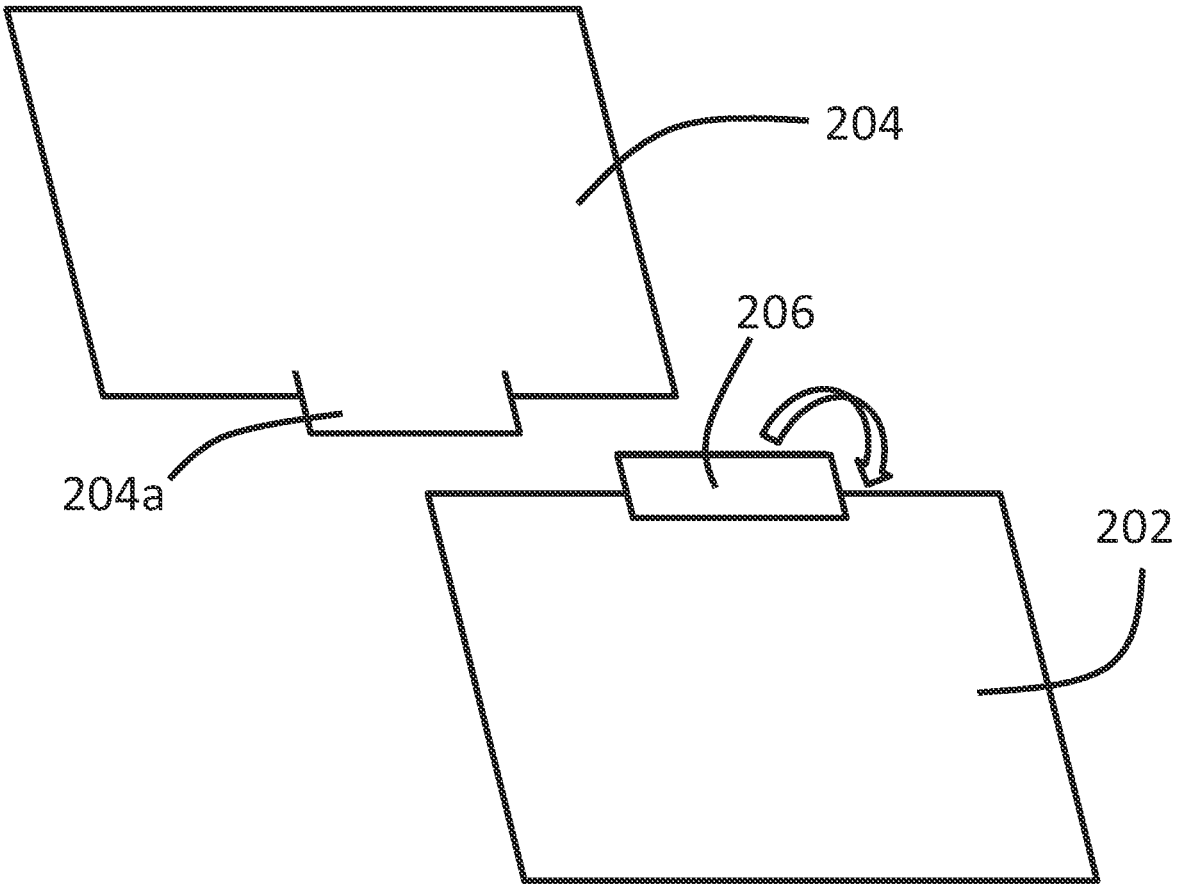
Figure 3C:
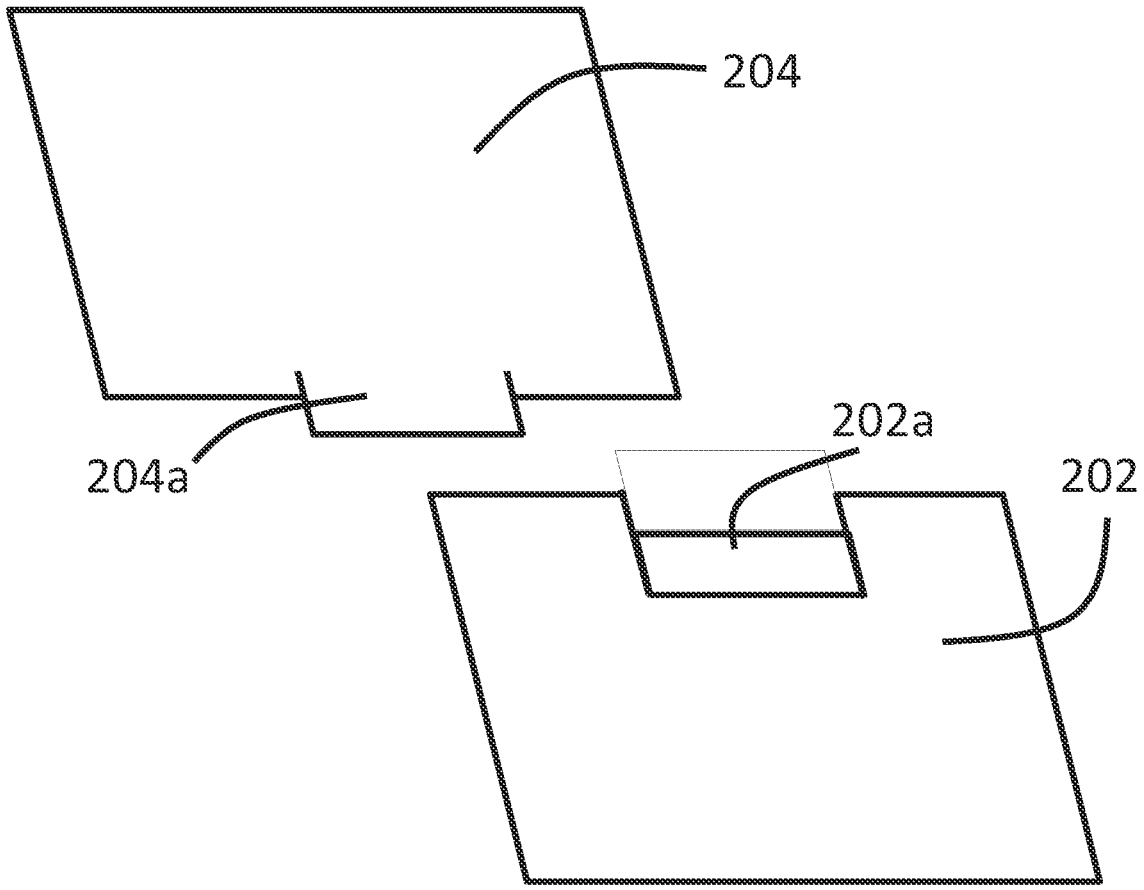
Figure 3D:
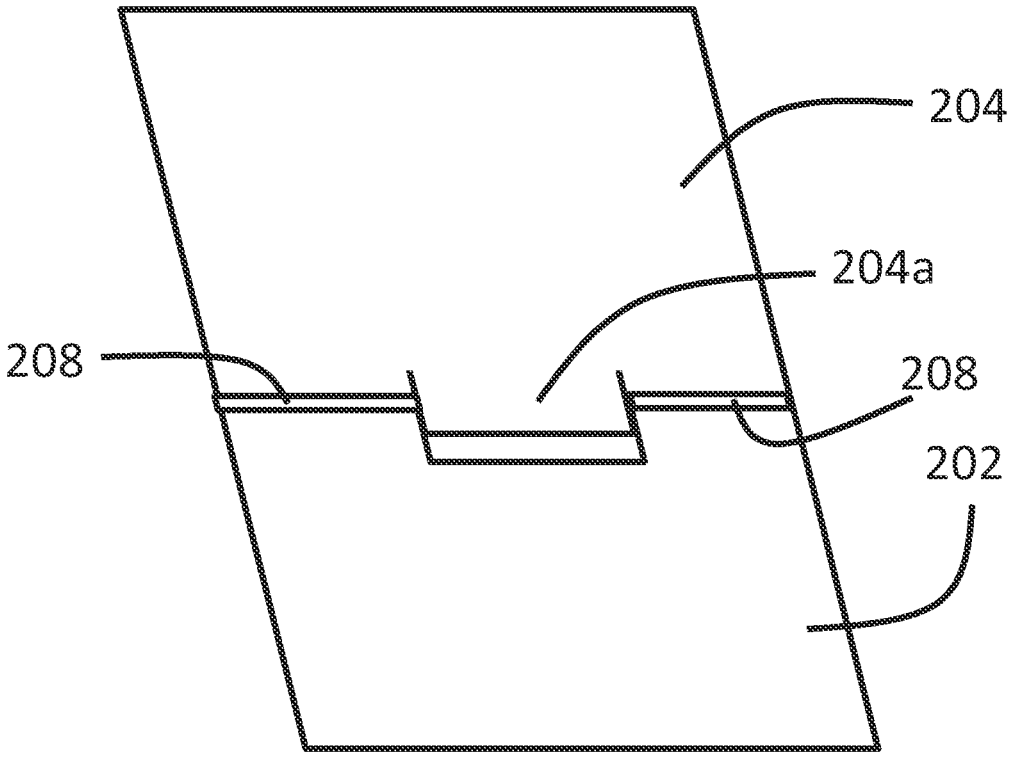
Figure 3E:
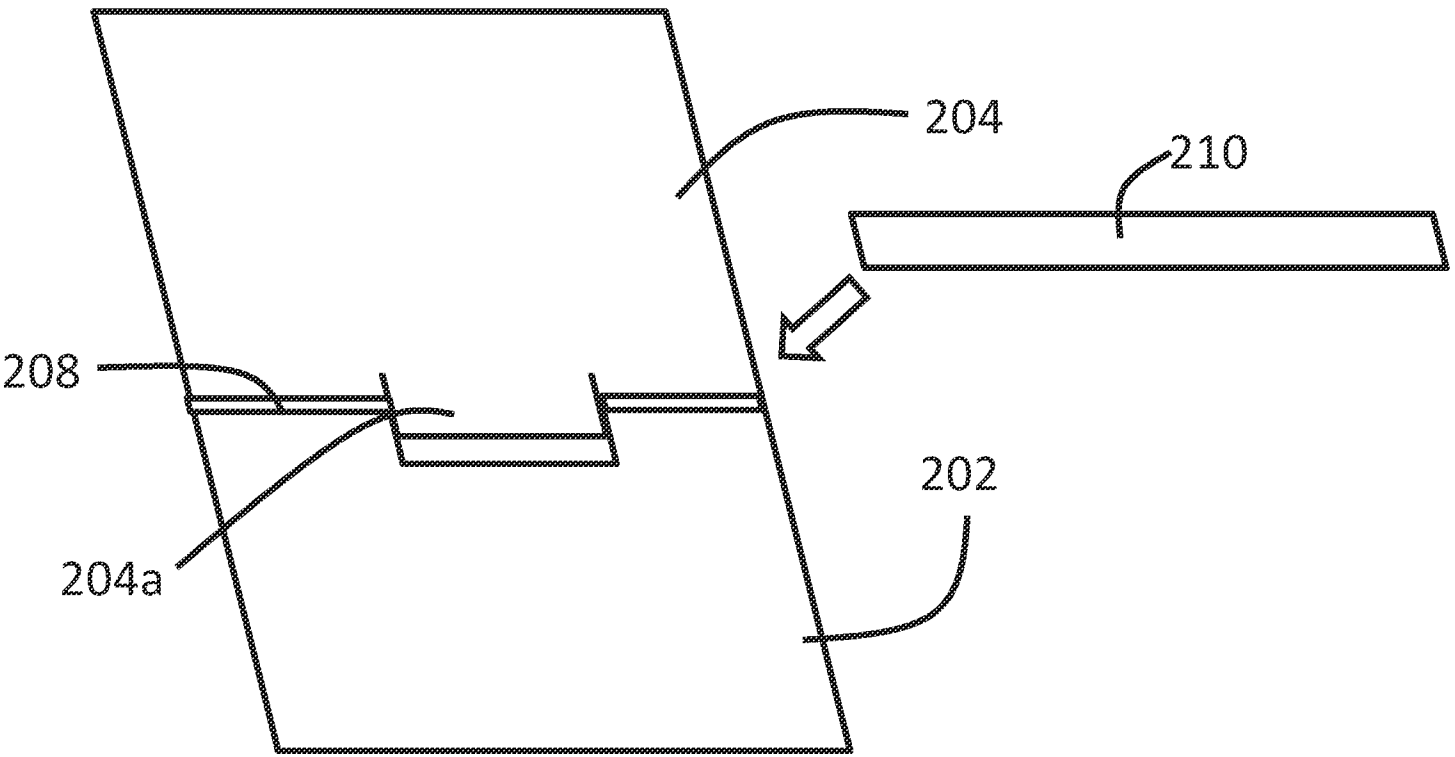

In some embodiments, the first fabric further comprises a first flap such as a flap 202*a* adjacent a first edge 202*b* of a first portion of the first fabric, as illustrated in FIG. 3A. The flap 202*a* is extended from the first portion of the first fabric beyond the first edge 202*b* of the first portion of the first fabric. The second fabric further comprises a second flap such as a flap 204*a*, adjacent a second edge 204*b* of the first portion of the second fabric. The flap 204*a* is extended from the first portion of the second fabric beyond the second edge 204*b* of the first portion of the second fabric.

In some embodiments, the first flap of the first fabric is folded over to the first portion of the first fabric, and the folded first flap of the first fabric and the second flap of the second fabric collectively define an opening 224 of the pocket. In an embodiment, the folded first flap of the first fabric is adhered to the first portion of the first fabric by an adhesive layer such as an adhesive layer 206 illustrated in FIG. 4.

In some embodiments, the first edge 202*b* of the first portion of the first fabric and the second edge 204*b* of the first portion of the second fabric are joined together and collectively form a seam. In an embodiment, the opening of the pocket is substantially aligned with the seam.

Figure 3G:
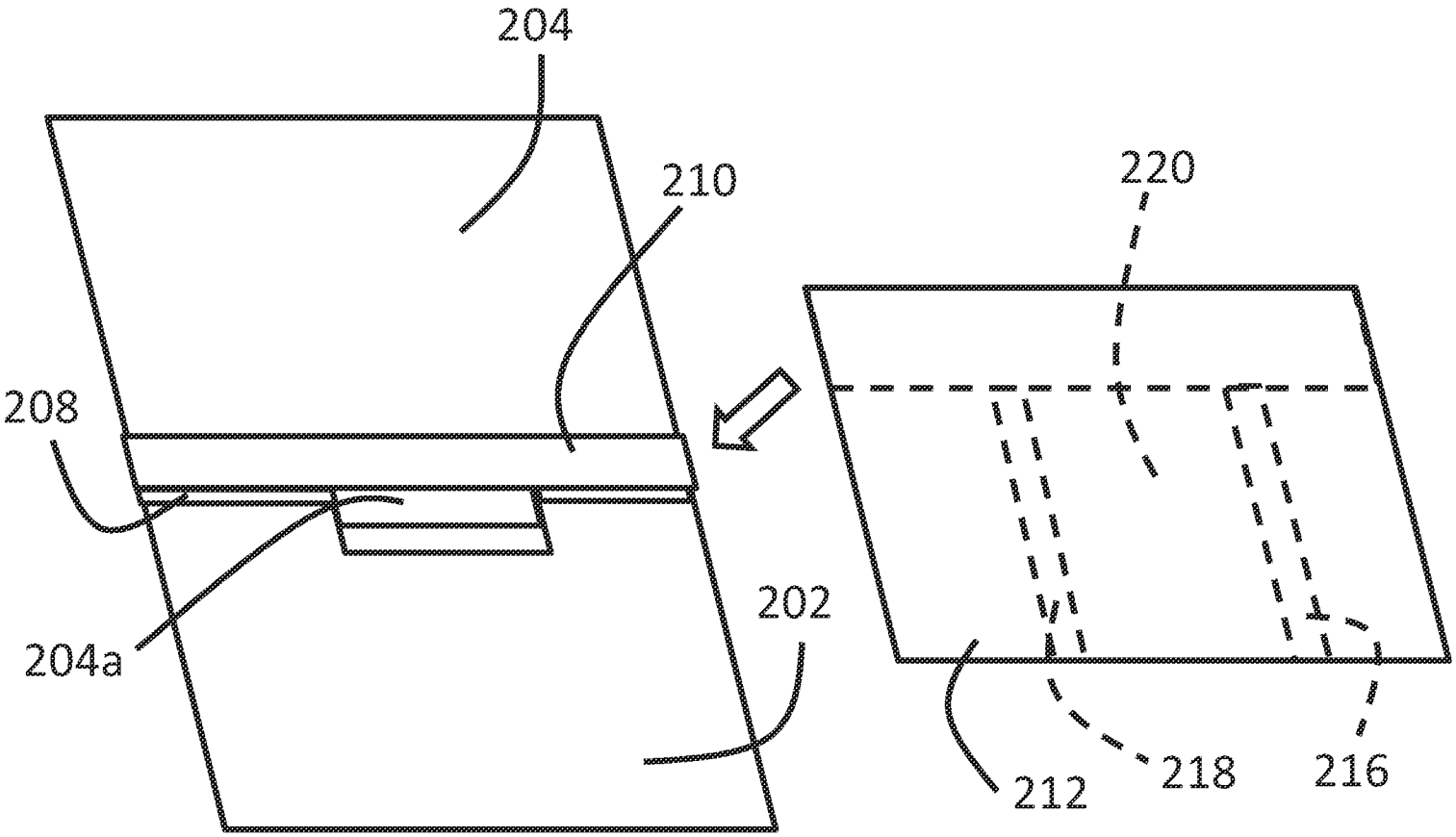
Figure 3H:
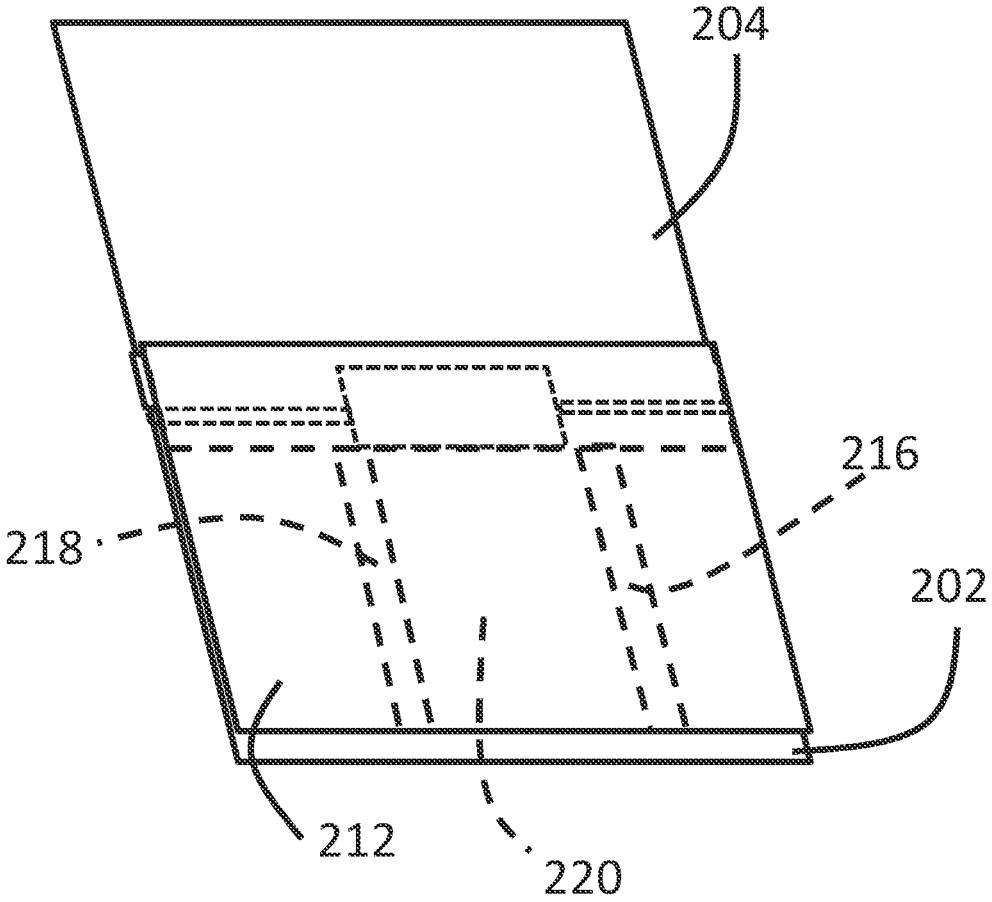
Figure 3I:
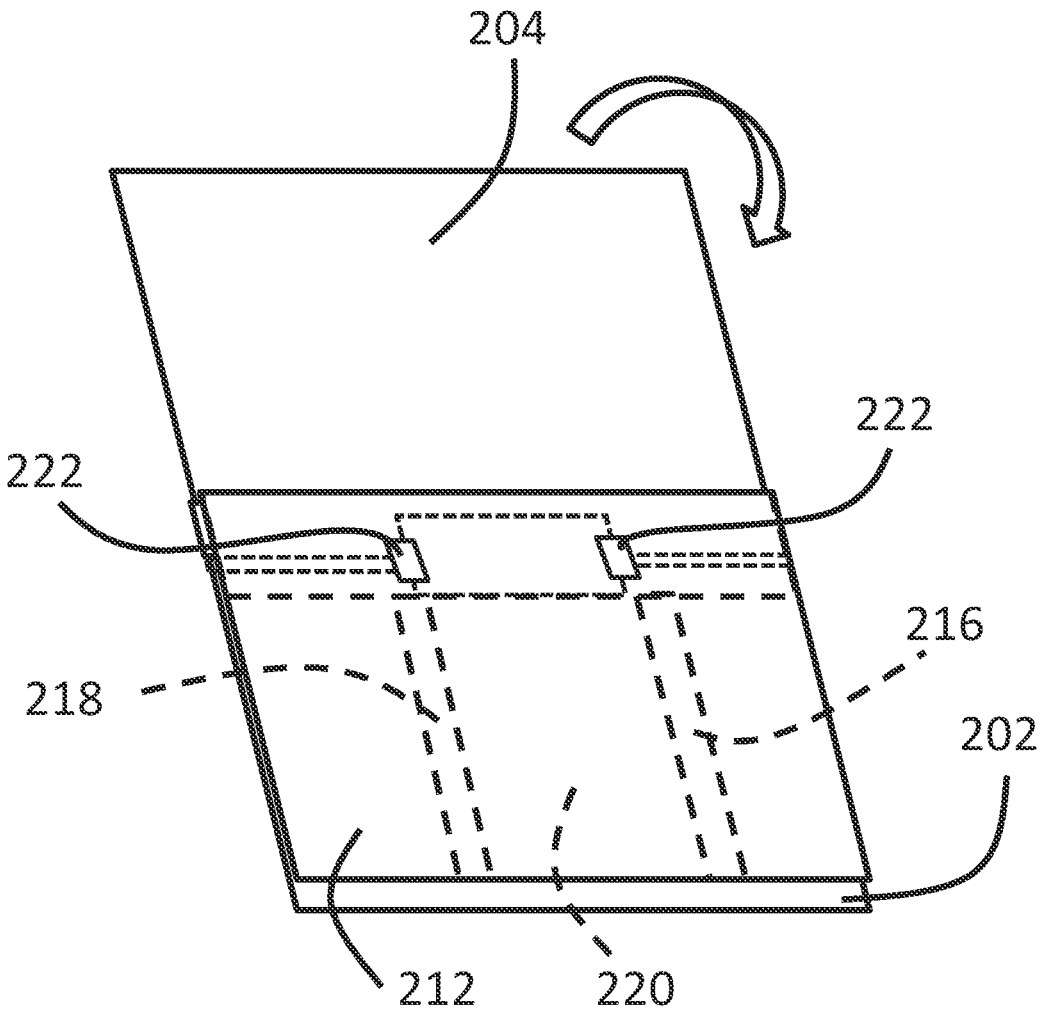
Figure 3J:
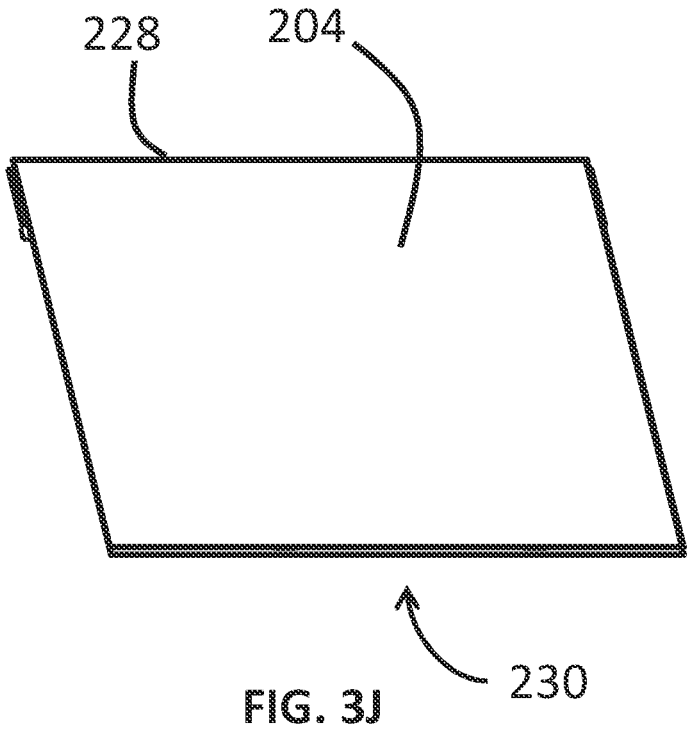
Figure 3K:
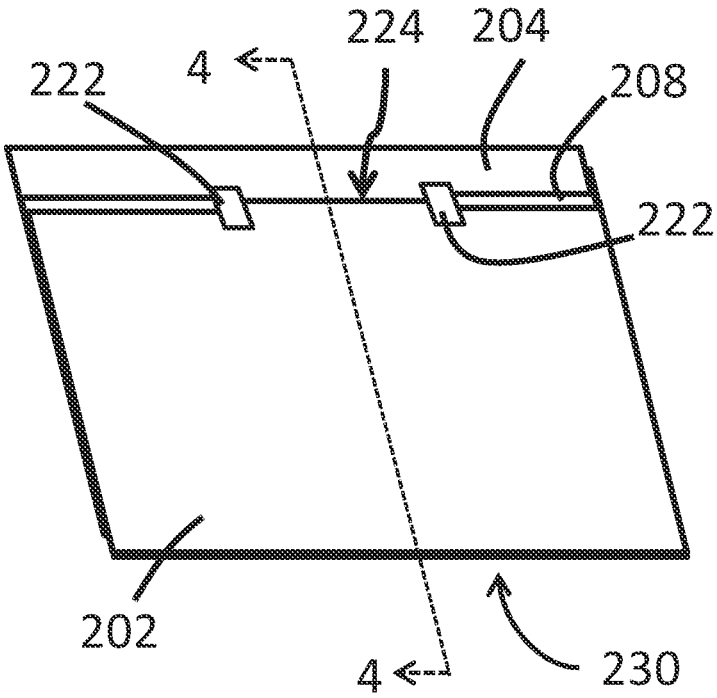

In some embodiments, a waistband of the present invention further comprises bar tacks, such as bar tacks 222 illustrated FIG. 3K, disposed respectively at the ends of a folding line of the folded first flap of the first fabric (e.g., the opening of the pocket). The bar tacks are configured to reinforce the folded first flap of the first fabric. In an embodiment, each of the bar tacks extends at least through the first fabric to the mesh layer.

Figure 7A:
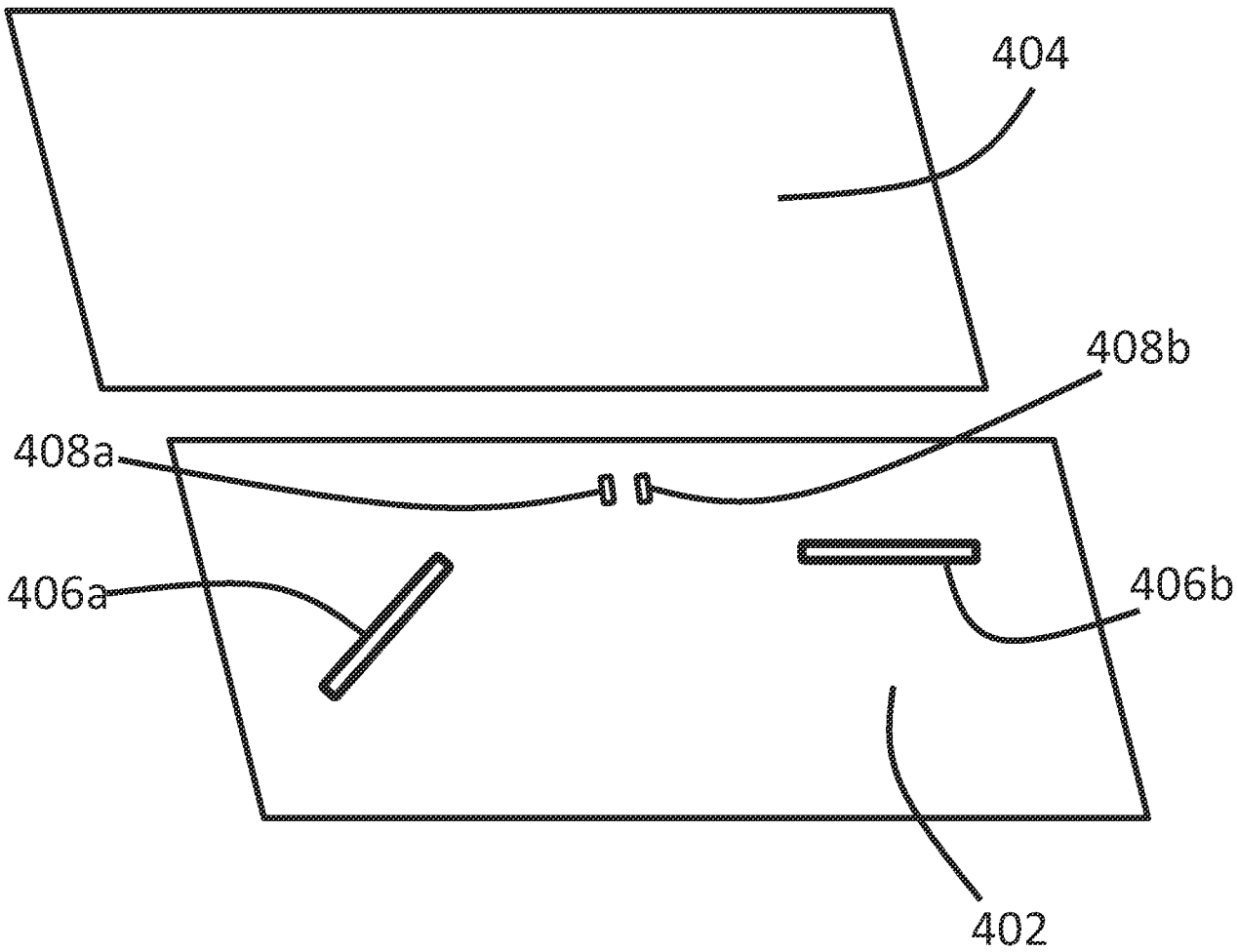
FIGS. 7A-7H are schematic views illustrating exemplary steps for constructing an exemplary waistband having an exemplary drawstring tunnel and one or more exemplary pockets in accordance with another exemplary embodiment of the present invention.
Figure 7B:
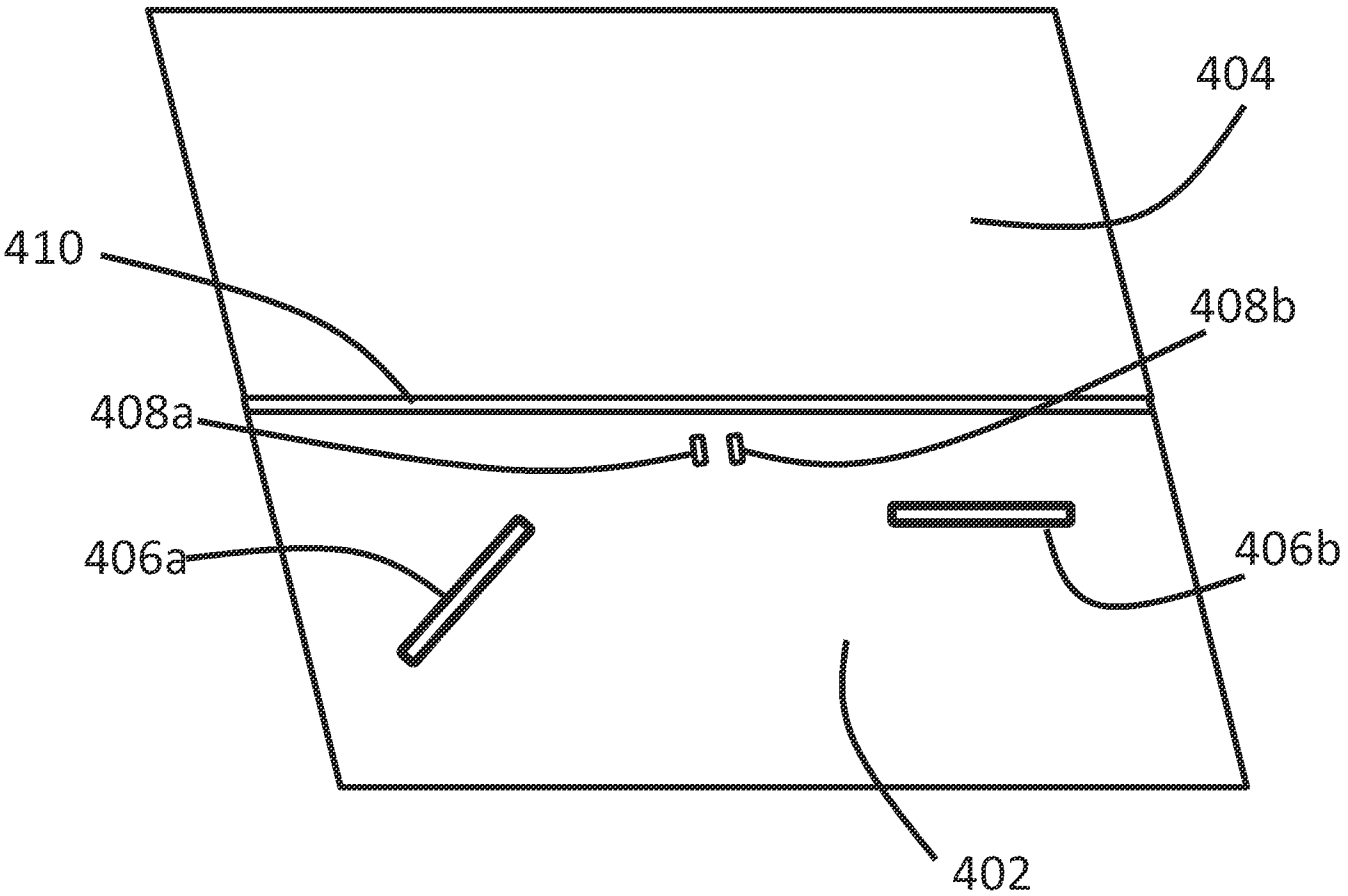
Figure 7C:
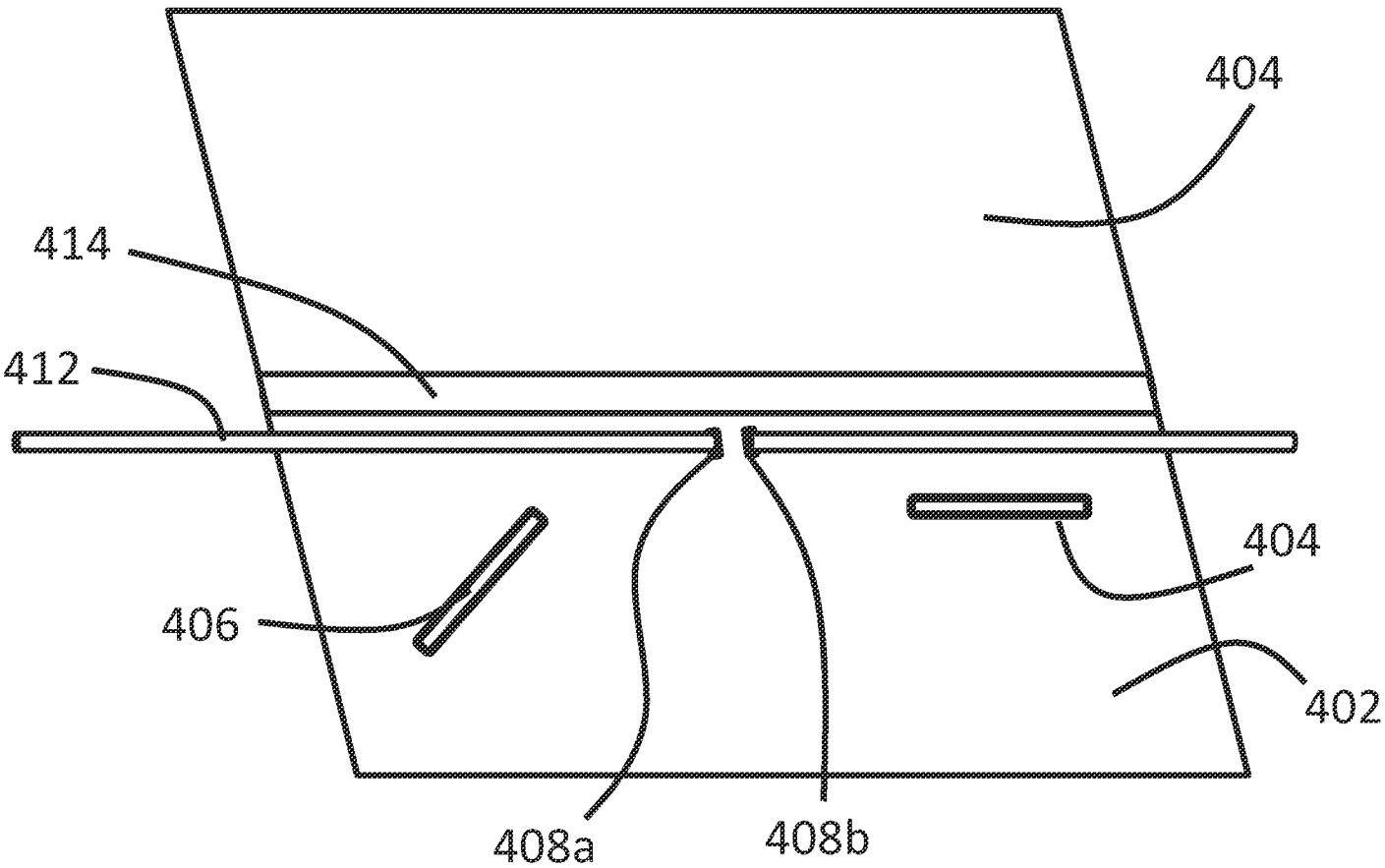
Figure 7D:
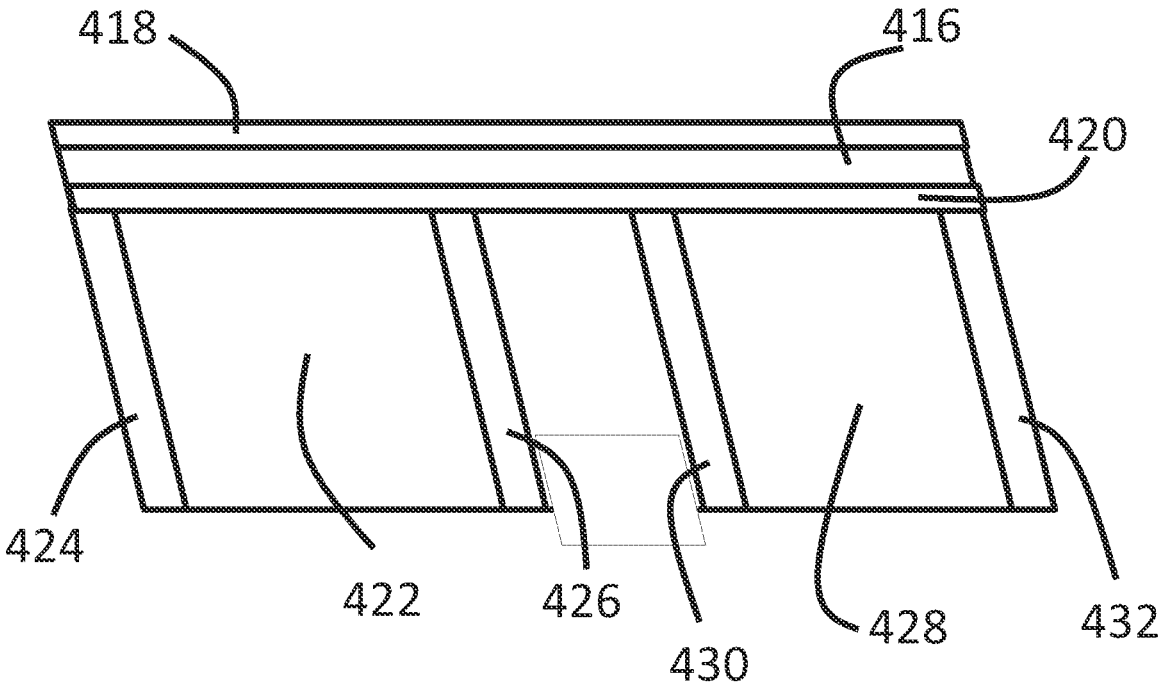
Figure 7E:
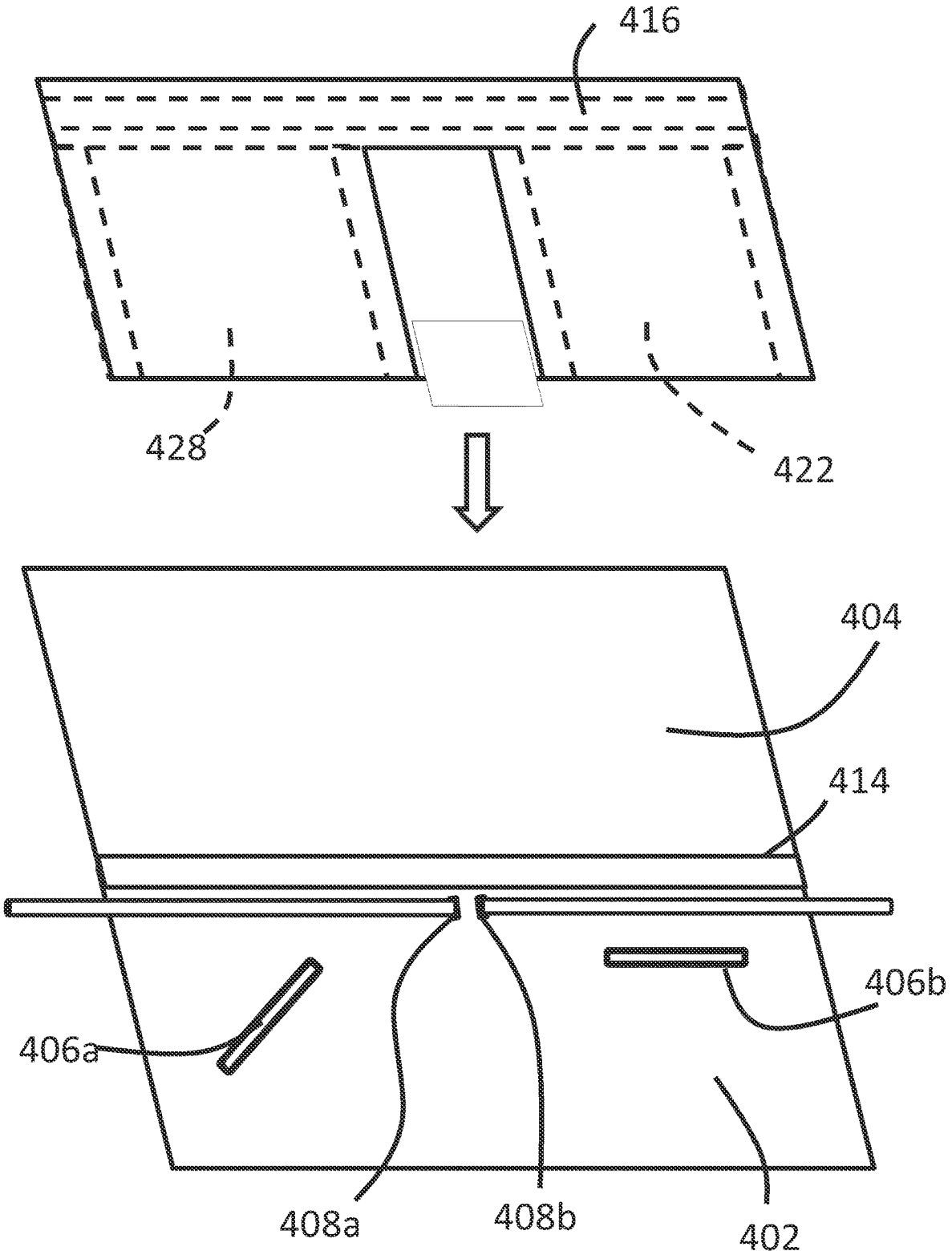

As a further example, FIGS. 7D-7E illustrates an exemplary waistband with one or more pockets constructed differently than that illustrated in FIG. 4. In FIGS. 7D-7E, the first fabric is formed with one or more openings, such as openings 406*a* and 406*b*, each defining an opening of a pocket. In some embodiments, for each pocket, the waistband further comprises one or more adhesive strips, such as adhesive strips 424, 426, 430, 432, disposed between the first fabric and the mesh layer to couple the mesh layer with the first fabric and to define a border of each pocket. Like the embodiment in FIG. 3F, the one or more adhesive strips can be but not necessarily have to be parallel or perpendicular to each other. Also, the one or more adhesive strips can be straight, slant, or curved.

Figure 7H:
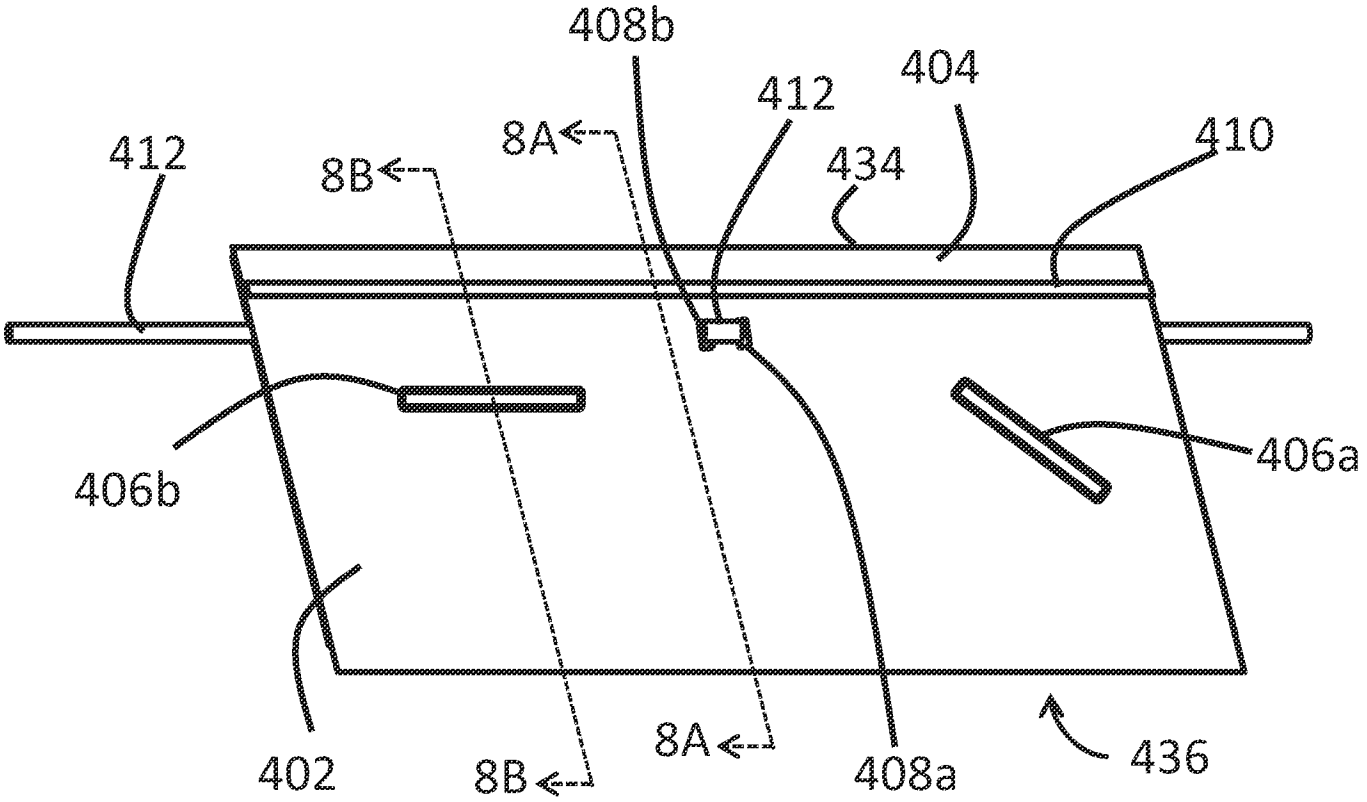
Figure 8A:
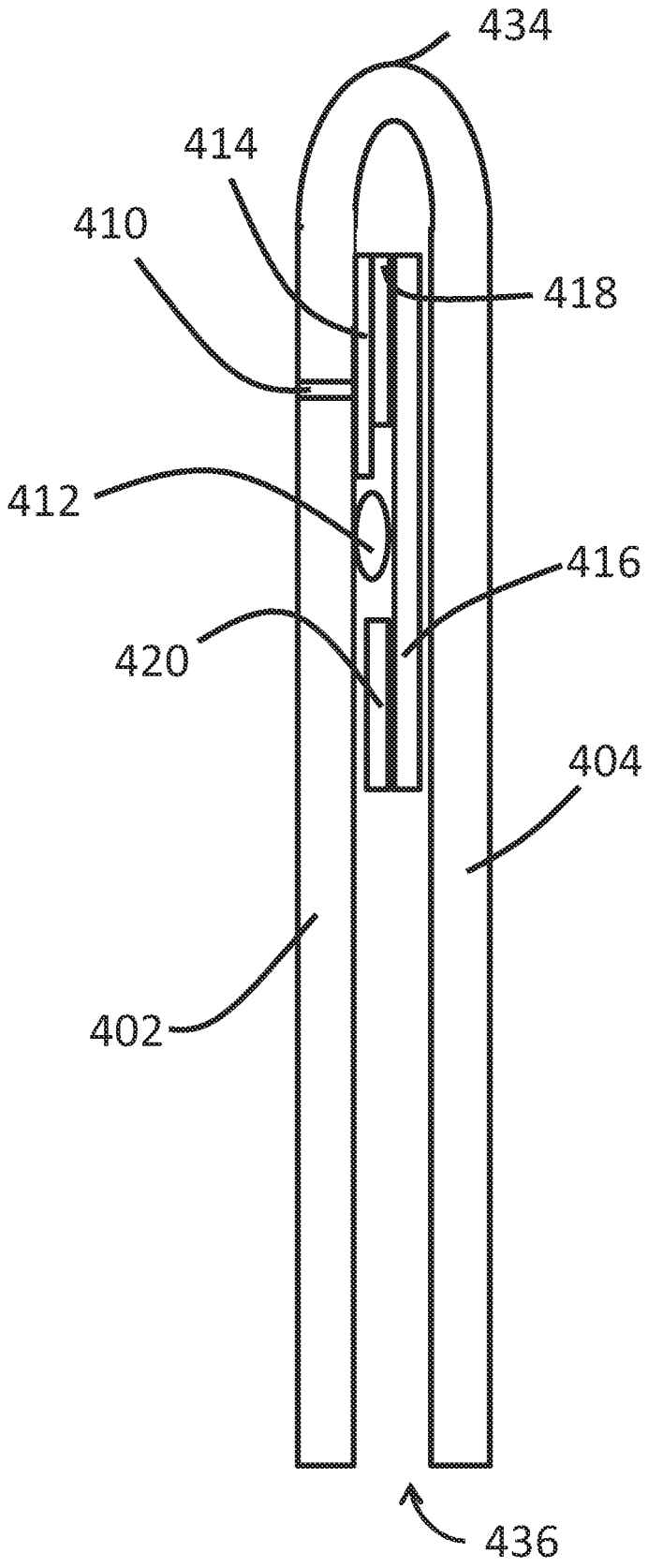
FIG. 8A is a cross-sectional view of a waistband constructed according to the steps provided in FIGS. 7A-7H taken along a plane designated by line 8A-8A in FIG. 7H.
Figure 8B:
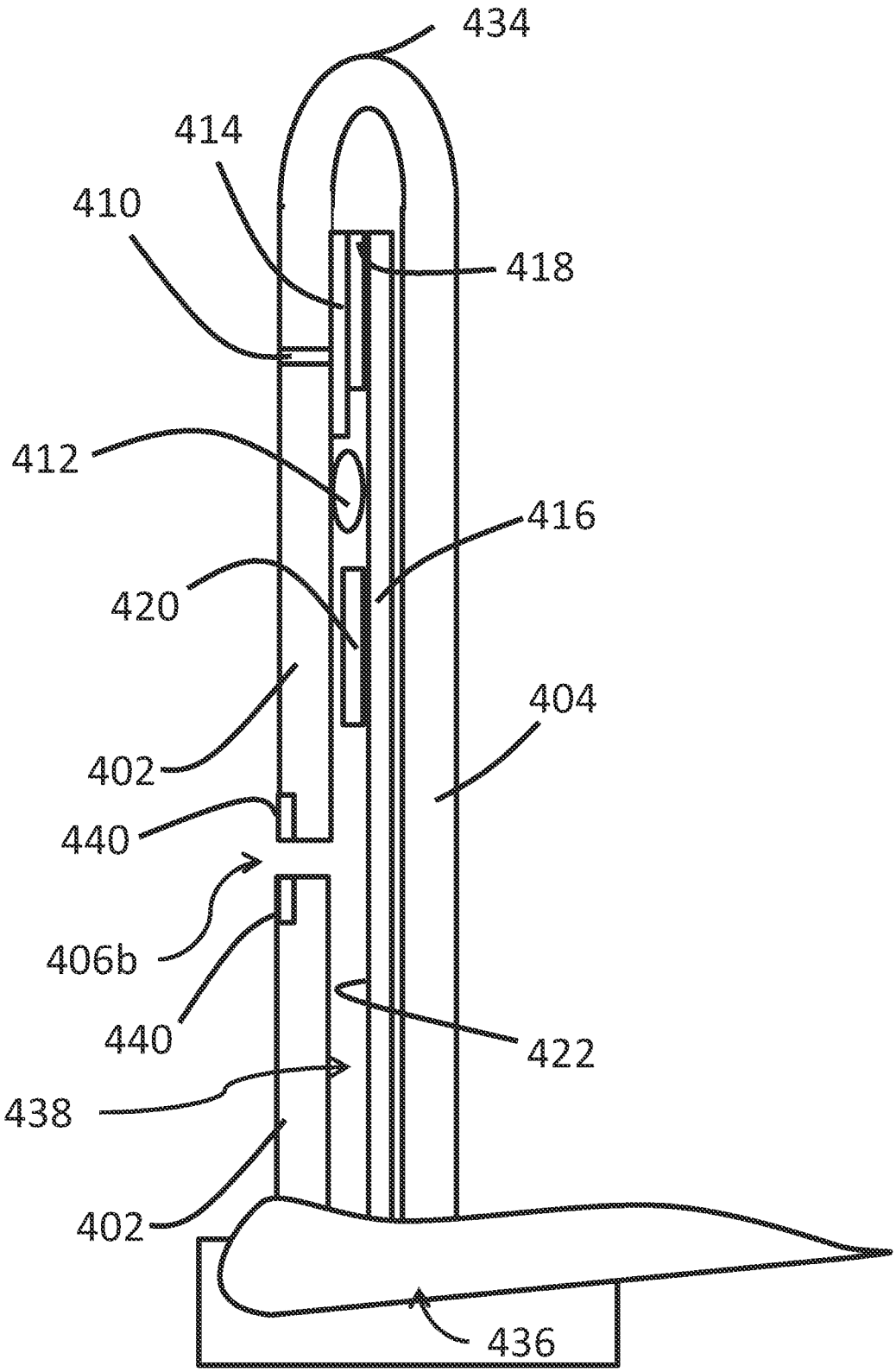
FIG. 8B is a cross-sectional view of a waistband constructed according to the steps provided in FIGS. 7A-7H taken along a plane designated by line 8B-8B in FIG. 7H.

As a still further example, FIGS. 8A and 8B illustrate an exemplary waistband with a non-continuous second adhesive layer. In the illustrated embodiment, the second adhesive layer comprises an adhesive strip 418 disposed at the upper region of the waistband and an adhesive strip 420 disposed at the middle region of the waistband. The adhesive strip 420 is spaced apart from the adhesive strip 418 of the second adhesive layer, and in some case is also spaced apart from the first adhesive layer 414, to form a tunnel for receiving a drawstring 412. In some embodiments, the first fabric is formed with a pair of holes such as holes such as drawstring holes 408*a*, 408*b* illustrated in FIG. 7H. In such embodiments, a portion of the drawstring can be exposed to an exterior of the tunnel through the pair of holes to allow adjustment of the tightness of the waistband.

Figure 6:
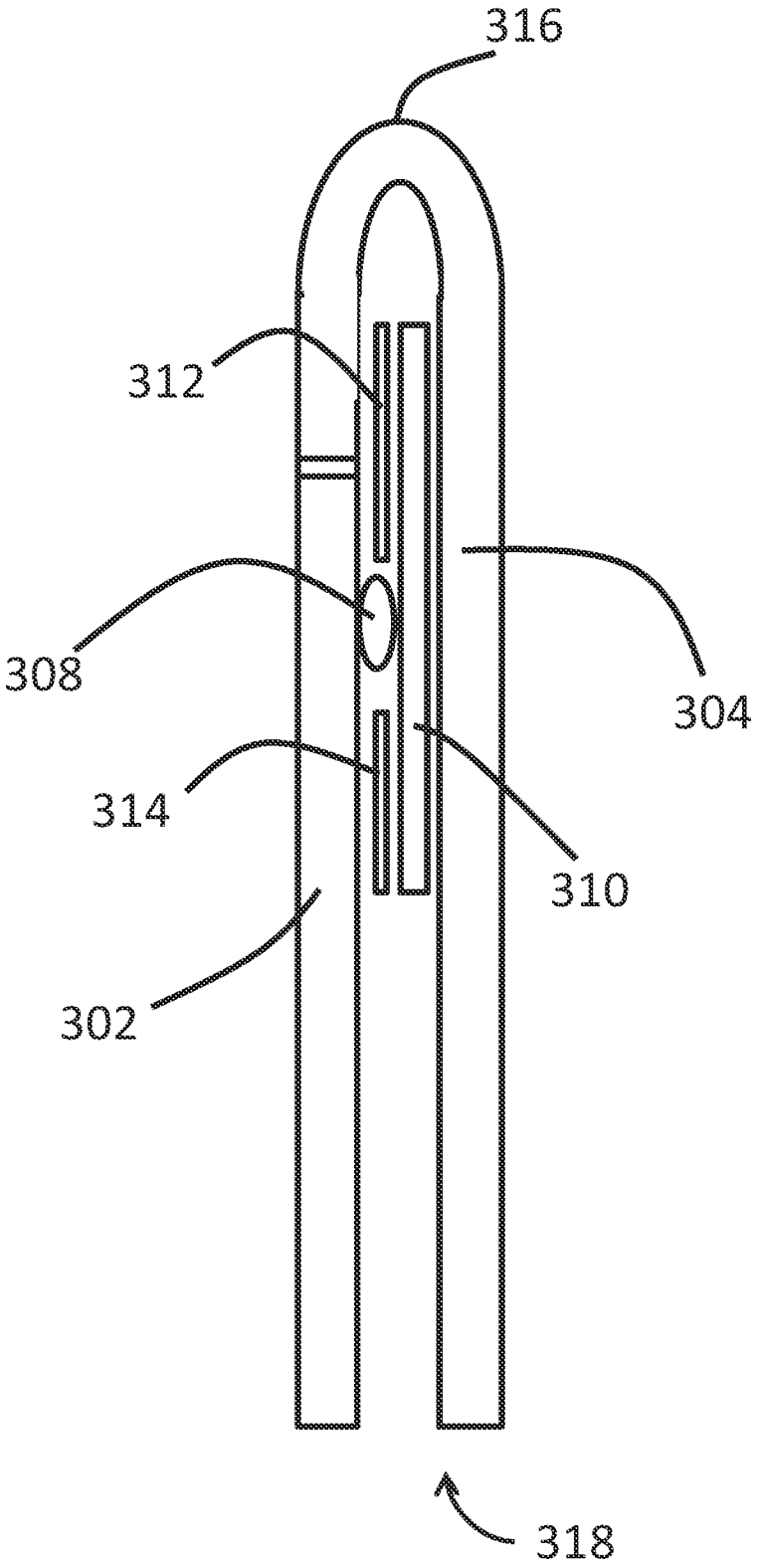
FIG. 6 is a cross-sectional view of a waistband constructed according to the steps provided in FIGS. 5A-5I taken along a plane designated by line 6-6 in FIG. 5I.

In an alternative embodiment such as that illustrated in FIG. 6, an exemplary waistband of the present invention comprises one adhesive layer, e.g., adhesive strips 312, 314, disposed between the mesh layer and the inner fabric layer. The adhesive strips 312, 314 are configured to couple the mesh layer with the inner fabric layer and to enhance the elastic strength of the waistband. In some embodiments, the adhesive strip and the second adhesive strip are spaced apart with a distance in between to form a tunnel for receiving a drawstring. In some embodiments, the adhesive layer 312 is disposed at the upper region of the waistband and the adhesive layer 314 is disposed at the middle region of the waistband, where the adhesive layer 312 has an elastic modulus greater than that of the adhesive layer 314. In some embodiment, the inner and outer fabric layers are made of the first and second fabrics joined by a seam. In an embodiment, the first adhesive strip 312 is overlaid over the seam to reinforce the seam.

Referring now to FIGS. 1A-8, there are shown exemplary methods for constructing exemplary waistbands in accordance with some embodiments of the present invention. It should be appreciated that, for simplicity and clarity, the illustrations depict only a portion of the total waistband, and that one skilled in the art would understand that the methods and steps described herein may be applied to construct waistbands of any desired length. Also, unless specified otherwise, the illustrations are not necessarily shown to scale. Further, the specific methods and the specific sequences of each method described herein are for illustrative purposes and by way of example only. It should be appreciated that these specific methods and the specific sequences of each method are not limiting, and various modifications, including modifications on the specific methods and the orders of the specific sequences, can be contemplated.

Referring to FIGS. 1A-1I, there is shown an exemplary method for constructing an exemplary waistband according to certain exemplary embodiments of the present invention. FIG. 1A illustrates a first fabric 102 and a second fabric 104 being provided to construct a waistband. In some embodiments, first fabric 102 will form an inside portion or a part of the inside portion of the waistband intended to face towards a person's body when worn, and second fabric 104 will form an outside portion of the waistband intended to face away from the person's body when worn. First fabric 102 and second fabric 104 may be the same material or different materials. For instance, in an embodiment, the first and second fabrics are made of the same material. In another embodiment, the first and second fabrics are made of different materials. In some embodiments, one or each of first fabric 102 and second fabric 104 is a synthetic fabric as described herein (e.g., polyester, spandex, rayon, nylon, acrylic, etc.).

Figure 1B:
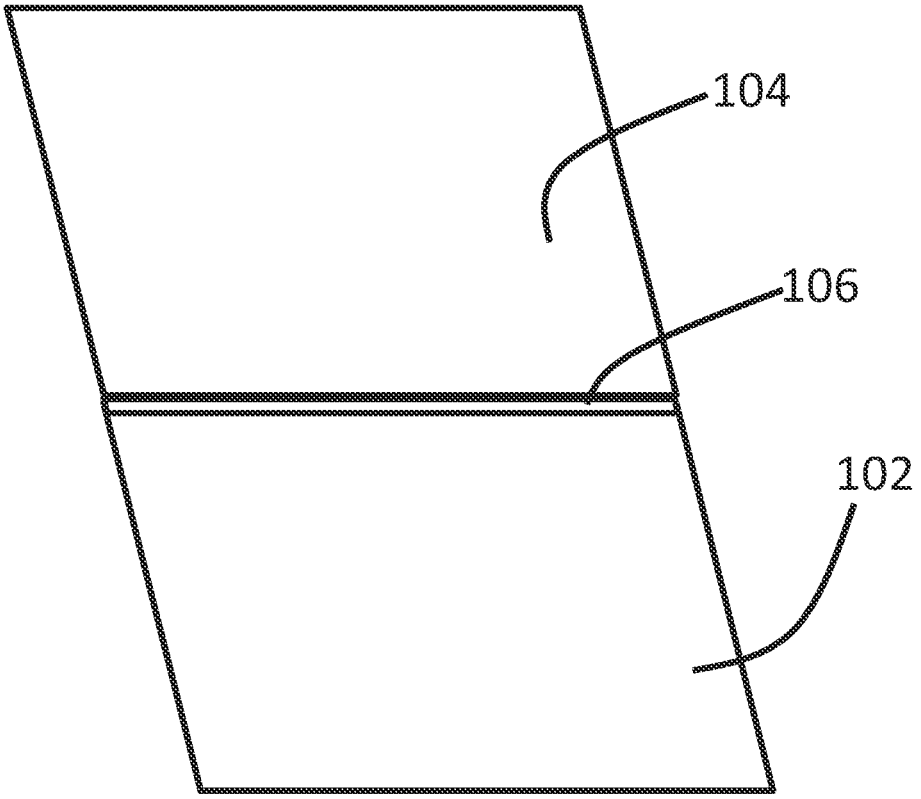

As illustrated in FIG. 1B, first fabric 102 is joined to second fabric 104 in some embodiments. In some embodiments first fabric 102 is joined to second fabric 104 by a seam 106. Seam 106, in some embodiments, may be formed between and extend along an edge of first fabric 102 and an edge of second fabric 104. In some embodiments, seam 106 extends an entire length of first fabric 102 and/or second fabric 104. In certain embodiments, seam 106 is a stitch-free seam which does not include or require any stitching or sewing. In some such embodiments, seam 106 is formed by bonding or welding first fabric 102 with second fabric 104 using, for example, heat, adhesives, and/or ultrasonic energy. In some embodiments, seam 106 is an ultrasonic line bonded (USLB) seam.

In some embodiments, an exemplary method of constructing an exemplary waistband includes: (i) stacking the first and second fabrics together, where an edge of the first fabric and an edge of the second fabric are substantially aligned with each other, (ii) placing the fabric stack in a machine (e.g., an anvil or fixture of an ultrasonic bonding machine, a horn of which presses together the fabric edges and delivers ultrasonic vibrations that heat the fabric edges) to join the edges of the first and second fabrics and form a seam, (iii) unfolding the fabric stack, and (iv) applying an adhesive layer (e.g., seam reinforcement tape) to the seam. In some embodiments, the method includes one or more optional or additional steps. For instance, in an embodiment, the method includes cutting off excess fabric at the seam after the seam is formed.

Figure 1C:
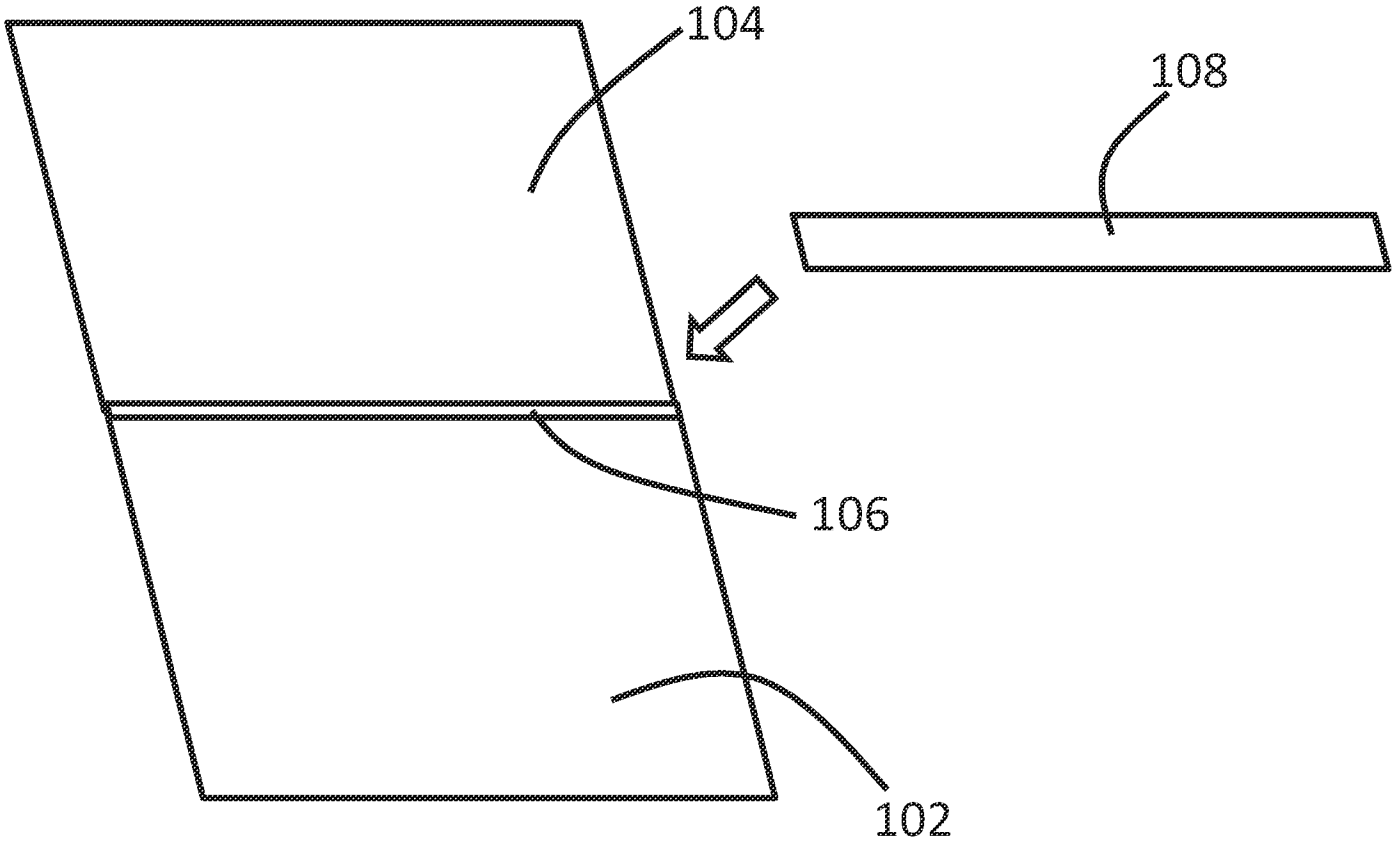

In some embodiments, a first adhesive layer 108 may be applied, as illustrated in FIG. 1C The first adhesive layer 108 may include, for example, an approximately 6 mm wide strip of adhesive material and, in some embodiments, is applied onto second fabric 104 on or adjacent to seam 106. In some embodiments, first adhesive layer 108 may be applied along the entire length of seam 106.

Figure 1D:
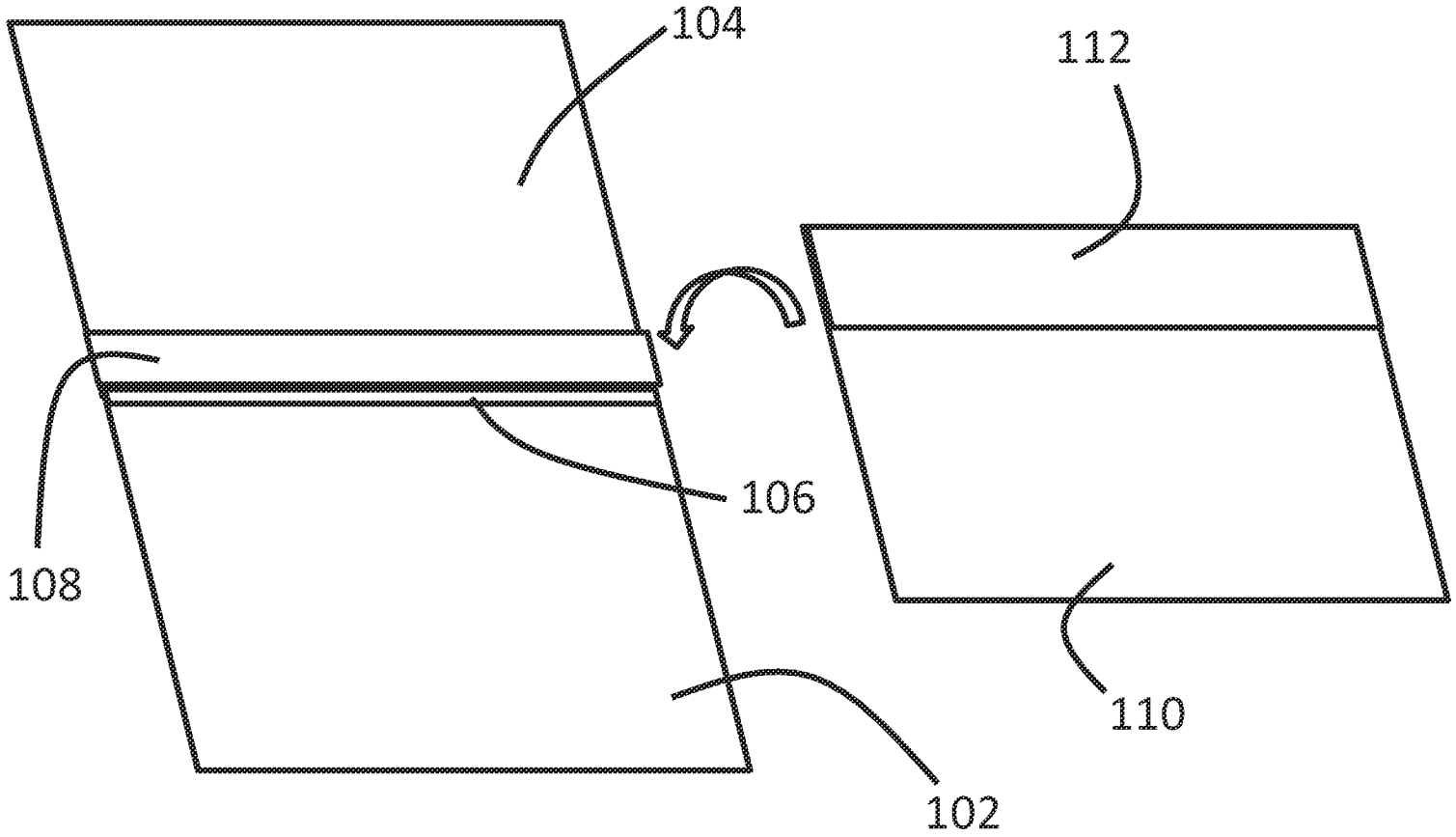

As shown in FIG. 1D, a layer of mesh 110 is provided according to some embodiments. Mesh 110 may be selected, for example, from any of the mesh materials described herein. In some embodiments, one side of mesh 110 is provided with a second adhesive layer 112. Second adhesive layer 112, in some embodiments, includes a strip of adhesive material that is wider than first adhesive layer 108. Second adhesive layer 112 may include, for example, an approximately 1.5 centimeter (cm) wide strip of adhesive material which is positioned along a lengthwise edge of mesh 110. The adhesive material used for second adhesive layer 112 may be the same adhesive material used for first adhesive layer 108.

Figure 1E:
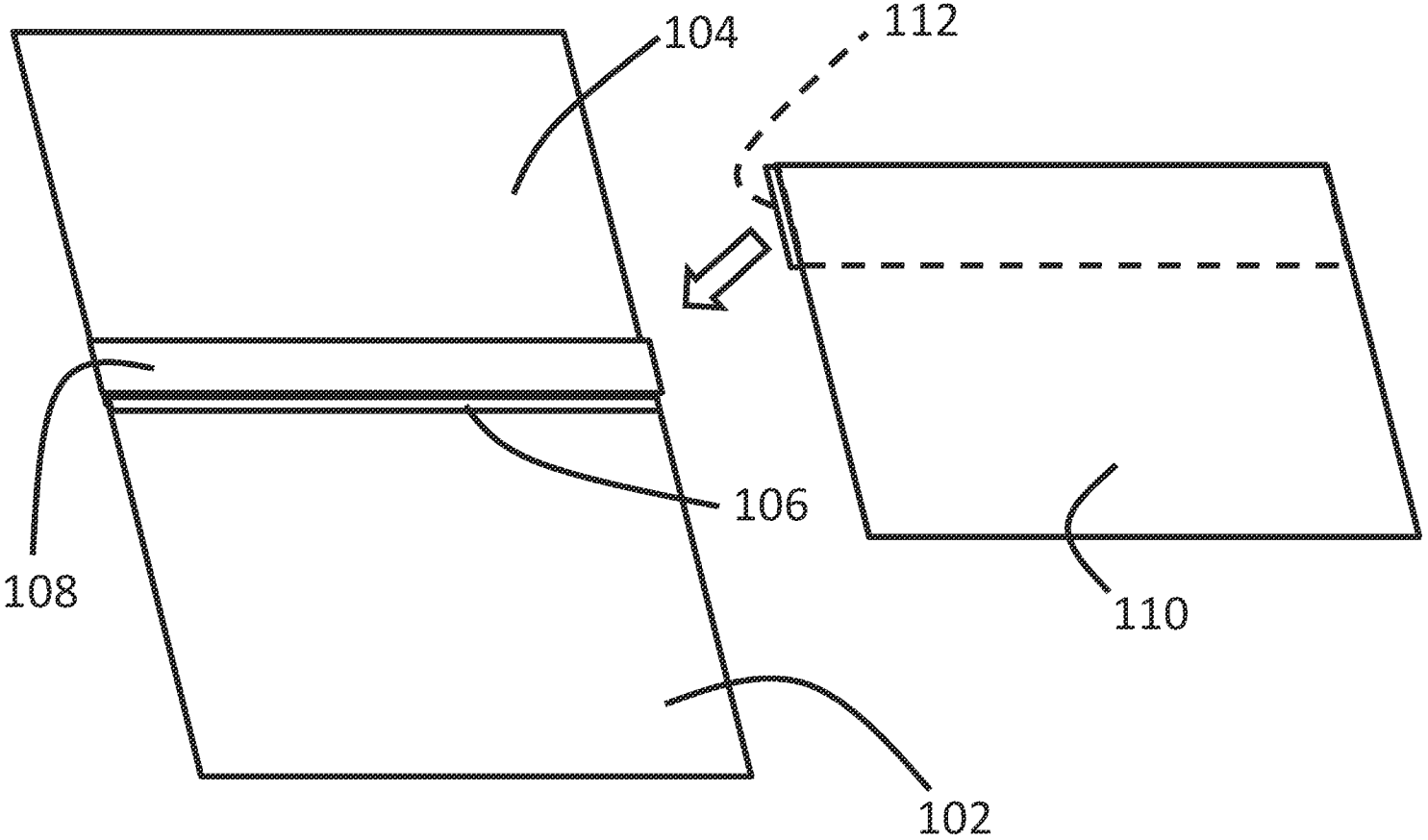
Figure 1F:
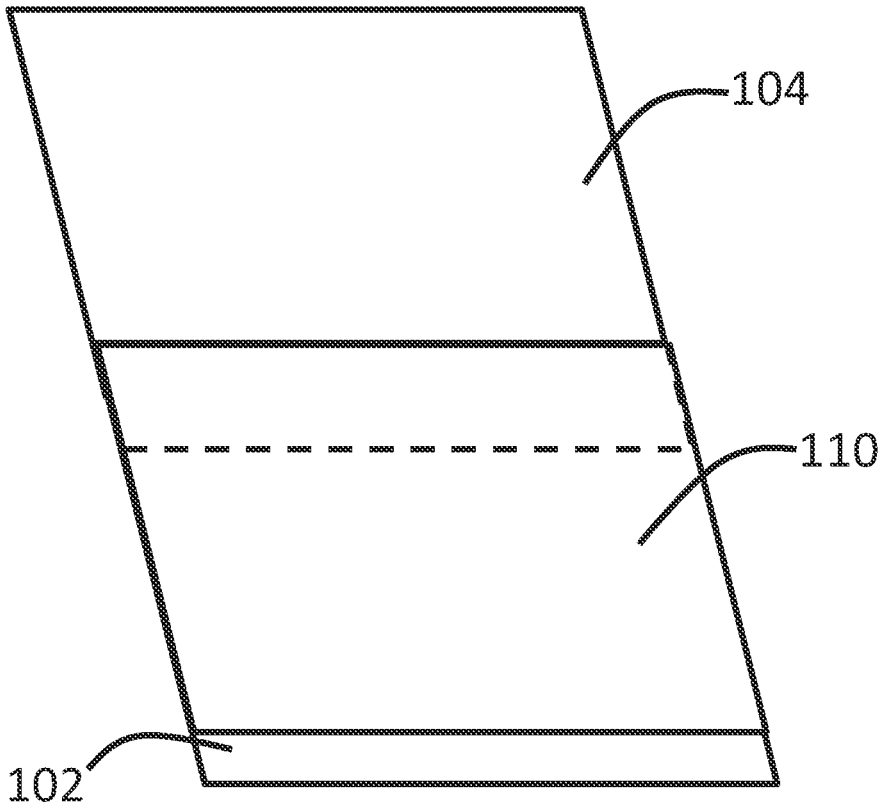

In some embodiments, mesh 110 may be coupled to the joined first fabric 102 and second fabric 104, as generally shown in FIGS. 1E and 1F. In some such embodiments, mesh 110 is positioned such that second adhesive layer 112 on mesh 110 faces and overlays first adhesive layer 108 and seam 106. Second adhesive layer 112 on mesh 110 may also overlay a portion of first fabric 102 in some embodiments (e.g., a portion which is adjacent to seam 106). Moreover, in some embodiments, a remainder of mesh 110 may be positioned to overlay first fabric 102. Accordingly, in some embodiments, first adhesive layer 108 and second adhesive layer 112 are brought in contact with each other and are configured to adhere mesh 110 to first and second fabric 102, 104.

Figure 1G:
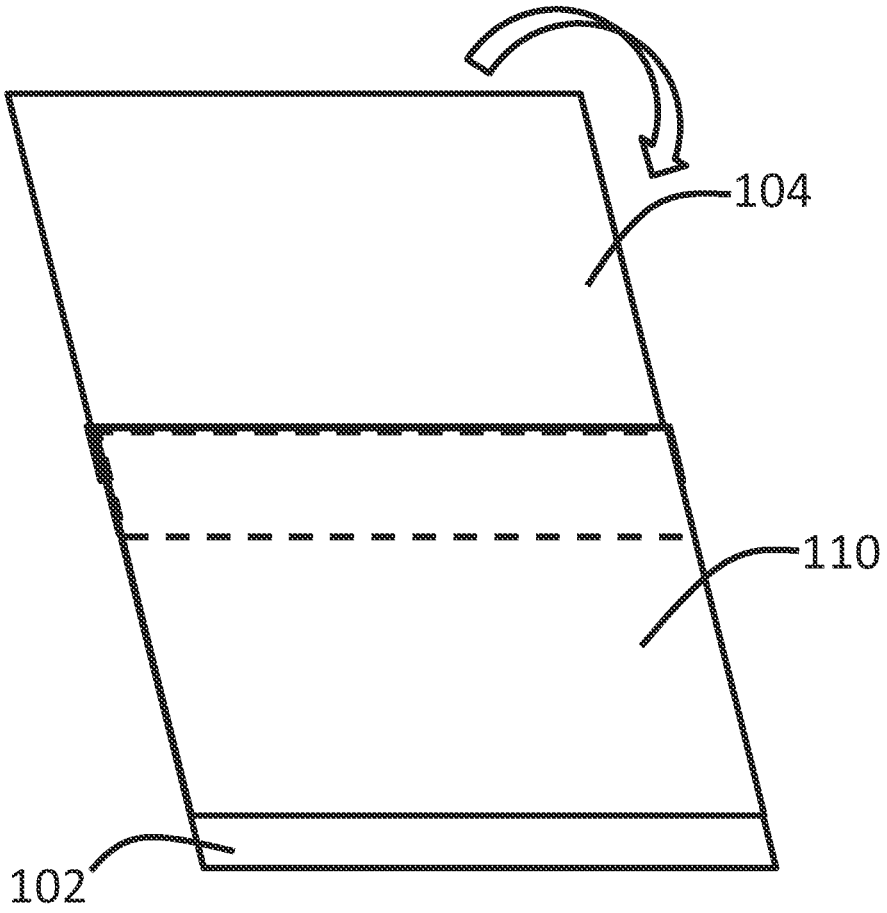
Figure 1H:
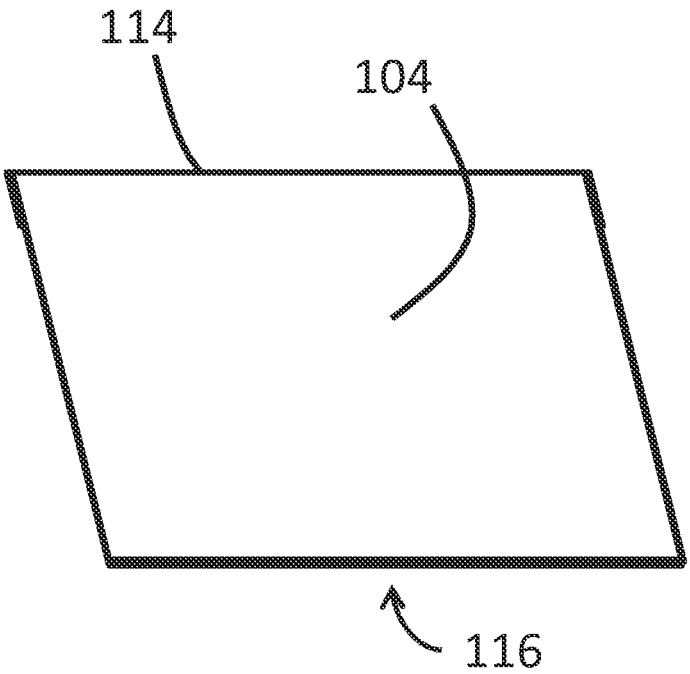
Figure 1I:
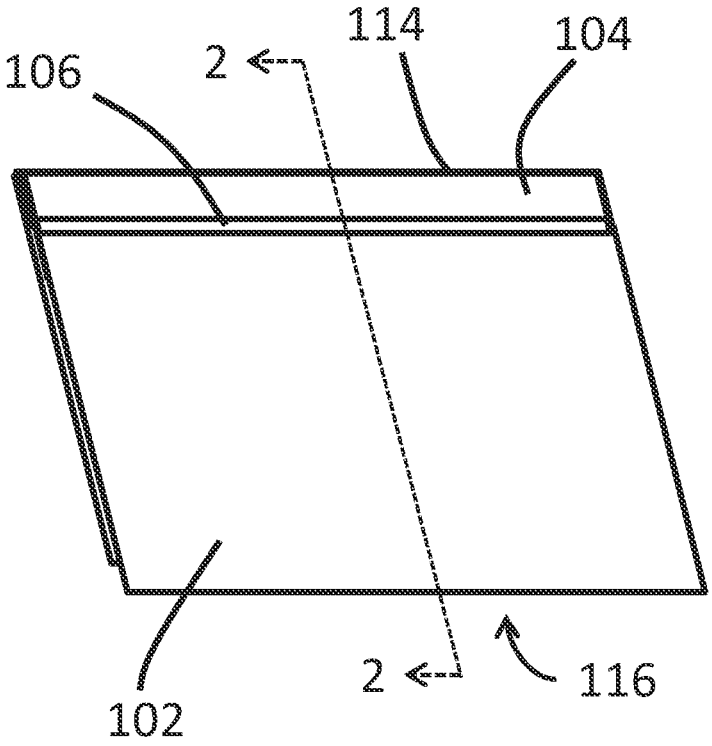

As shown in FIG. 1G, a portion of second fabric 104 may be folded over mesh 110, resulting in a configuration such as that depicted in FIG. 111, where fold 114 in fabric 104 forms a top edge of the waistband. A bottom portion 116 of the waistband, which is opposite of fold 114, in some embodiments, may be attached to additional materials that will be used to form the remainder of the article of clothing, e.g., by sewing, stitching, or other known methods. In particular, FIG. 111 shows a first side of the resulting waistband construction according to certain embodiments, which is formed mostly or entirely from second fabric 104. In some embodiments, the first side shown in FIG. 111 represents an exterior side of the waistband that is intended to face away from the wearer's body. An opposite, second side of the resulting waistband construction is shown in FIG. 1I, which may represent an interior side of the waistband that is intended to face toward the wearer's body. In particular, the second side of the waistband construction, in some embodiments, includes first fabric 102, seam 106, and a portion of second fabric 104. In some such embodiments, seam 106 can therefore be hidden from view, which may be desirable for aesthetic reasons.

FIG. 2 shows a cross-sectional view of the waistband construction taken along the plane depicted by line 2-2 in FIG. 1I. As shown, mesh 110 is sandwiched between first fabric 102 and folded second fabric 104 and is secured thereto by first and/or second adhesive layers 108, 112. In some embodiments, fold 114, where second fabric 104 is folded over mesh 110, forms a top edge of the waistband construction. The opposite bottom portion 116 of the waistband may be connected to the remainder of the article of clothing (e.g., pant legs, skirt, etc.), for example, by sewing, stitching, or other known methods. In some embodiments, first fabric 102, second fabric 104, and/or mesh 110 may be sewn, stitched, or otherwise attached together at bottom portion 116.

Referring now to FIGS. 3A-3K, there is shown a method for constructing a waistband according to another exemplary embodiment of the present invention. According to some embodiments, the method shown in FIG. 3A-3K may be used to construct a waistband having a pocket. FIG. 3A illustrates a first fabric 202 and a second fabric 204 being provided which may be used to construct the waistband. In some embodiments, first fabric 202 will form an inside portion of the waistband intended to face towards a person's body when worn, and second fabric 204 will form an outside portion of the waistband intended to face away from the person's body when worn. In some embodiments, first fabric 202 and second fabric 204 may be the same material or different materials. In some embodiments, each of first fabric 202 and second fabric 204 is a synthetic fabric as described herein (e.g., polyester, spandex, rayon, nylon, acrylic, etc.). In some embodiments, first fabric 202 includes a first flap 202*a* and second fabric 204 includes a second flap 204*a* which extend beyond a lengthwise edge of first and second fabrics 202, 204. In some such embodiments, as will be described further herein, first flap 202*a* and second flap 204*a* will be used to form an opening of a pocket formed in the waistband construction.

As illustrated in FIGS. 3B and 3C, in certain embodiments a first adhesive layer 206 may be applied to first flap 202*a*, which is folded over and adhered to another portion of first fabric 202. First adhesive layer 206 may include, for example, an approximately 1.0 cm wide strip of adhesive material applied along substantially the entire length of first flap 202*a*. Second fabric 204, in some embodiments, may be positioned such that at least a portion of second flap 204*a* overlays at least a portion of folded first flap 202*a*, as shown in FIG. 3D. Moreover, in some embodiments, lengthwise edges of second fabric 204 that are adjacent to second flap 204*a* are aligned with and joined to lengthwise edges of first fabric 202 that are adjacent to first flap 202*a* by seams 208. In certain embodiments, seams 208 are stitch-free seams which does not include or require any stitching or sewing. In some such embodiments, seams 208 are formed by bonding or welding first fabric 202 with second fabric 204 using, for example, heat, adhesives, and/or ultrasonic energy. In some embodiments, seams 208 are an ultrasonic line bonded (USLB) seams. Second flap 204*a* remains unbonded to first flap 202*a* to create a gap between seams 208 and provide an opening to the pocket.

As shown in FIG. 3E, a second adhesive layer 210 may be applied according to some embodiments. Second adhesive layer 210 may include, for example, an approximately 6 mm wide strip of adhesive material and, in some embodiments, is applied onto second fabric 204 on or adjacent to seams 208. In some embodiments, second adhesive layer 210 may also be applied over a portion of second flap 204*a*.

As shown in FIG. 3F, a layer of mesh 212 is provided according to some embodiments. Mesh 212 may be selected, for example, from any of the mesh materials described herein. In some embodiments, one side of mesh 212 is provided with a third adhesive layer 214. Third adhesive layer 214, in some embodiments, includes a strip of adhesive material that is wider than second adhesive layer 210. Third adhesive layer 214 may include, for example, an approximately 1.5 cm wide strip of adhesive material which is positioned along a lengthwise edge of mesh 212. The adhesive material used for third adhesive layer 112 may be the same adhesive material used for first adhesive layer 206 and/or second adhesive layer 210. In further embodiments, mesh 212 is further provided with additional adhesive strips 216 and 218 which are spaced apart from each other and, in some embodiments, extend generally perpendicular to third adhesive layer 214. In some embodiments, adhesive strips 216 and 218 are each narrower than third adhesive layer 214, for example, being approximately 1.0 cm wide according to some such embodiments. In some embodiments, adhesive strips 216 and 218 further border and define a pocket region 220 on mesh 212, which will form an inner wall of the pocket of the waistband.

In some embodiments, mesh 212 may be coupled to the joined first fabric 202 and second fabric 204, as generally shown in FIGS. 3G and 311. In some such embodiments, mesh 212 is positioned such that third adhesive layer 214 on mesh 212 faces and overlays second adhesive layer 210 and seam 208. Third adhesive layer 214 on mesh 212 may also overlay a portion of first fabric 202 in some embodiments (e.g., a portion which is adjacent to seam 208) and second flap 204*a*. In some embodiments, third adhesive layer 214 is sized and positioned such that it does not contact or adhere to first flap 202*a*. Moreover, in some embodiments, a remainder of mesh 212, including adhesive strips 216, 218, may be positioned to overlay first fabric 202. Accordingly, in some embodiments, second adhesive layer 210 and third adhesive layer 214 are brought in contact with each other and are configured to adhere mesh 212 to first and second fabric 202, 204. Furthermore, mesh 212 is adhered to first fabric 202 by adhesive strips 216, 218, which define the sides of the pocket formed between first fabric 202 and pocket region 220 of mesh 212. In further embodiments, the interior space of the pocket between first fabric 202 and pocket region 220 communicates with a pocket opening formed between first flap 202*a* and second flap 204*a*. In some embodiments bar tacks 222 may be provided at either or both ends of the opening as reinforcement, as depicted in FIG. 31. Bar tacks 222 may be positioned and configured to extend at least through mesh 212, seam 208, first fabric 202, according to some embodiments. In other embodiments, bar tacks may be added on the sides of first and second flaps 202*a*, 204*a* prior to providing mesh 212, such that the bar tacks do not extend through mesh 212.

As shown in FIG. 31, a portion of second fabric 204 may be folded over mesh 212, resulting in a configuration such as that depicted in FIG. 3J, where fold 228 in fabric 204 forms a top edge of the waistband. A bottom portion 230 of the waistband, which is opposite of fold 228, in some embodiments, may be attached to additional materials that will be used to form the remainder of the article of clothing, e.g., by sewing, stitching, or other known methods. In particular, FIG. 3J shows a first side of the resulting waistband construction according to certain embodiments, which is formed mostly or entirely from second fabric 204. In some embodiments, the first side as shown in FIG. 3J represents an exterior side of the waistband that is intended to face away from the wearer's body. An opposite, second side of the resulting waistband construction is shown in FIG. 3K, which may represent an interior side of the waistband that is intended to face toward the wearer's body. In particular, the second side of the waistband construction, in some embodiments, includes first fabric 202, seam 208, and a portion of second fabric 204. Furthermore, pocket opening 224, formed between first flap 202*a* and second flap 204*a* is accessible through the second side of the waistband, as shown. In some such embodiments, seam 208 and pocket opening 224 can therefore be hidden from view, which may be desirable for aesthetic reasons. Furthermore, hiding pocket opening 224 on the interior side of the waistband may provide added security to the contents held in the pocket.

FIG. 4 shows a cross-sectional view of the waistband construction taken along the plane depicted by line 4-4 in FIG. 3K. As shown, mesh 212 is positioned between first fabric 202 and folded second fabric 204 and is secured to second fabric 204 by second and/or third adhesive layers 210, 214. In some embodiments, fold 228, where second fabric 204 is folded over mesh 110, forms a top edge of the waistband construction. As further depicted, first flap 202*a* of first fabric 202 is folded over and adhered using first adhesive layer 206. The space between first flap 202*a* and second flap 204*a* forms a pocket opening 224 which connects to interior space 226 of the pocket formed between first fabric 202 and pocket region 220 of mesh 212. Pocket opening 224 and interior space 226 may be sized, for example, to receive and hold coins, credit cards, keys, medicines, mobile telephones, or other small personal items. The bottom portion 230 of the waistband, opposite of fold 228, may be connected to the remainder of the article of clothing (e.g., pant legs, skirt, etc.), for example, by sewing, stitching, or other known methods. In some embodiments, first fabric 202, second fabric 204, and/or mesh 212 may be sewn, stitched, or otherwise attached together at bottom portion 230.

Figure 5A:
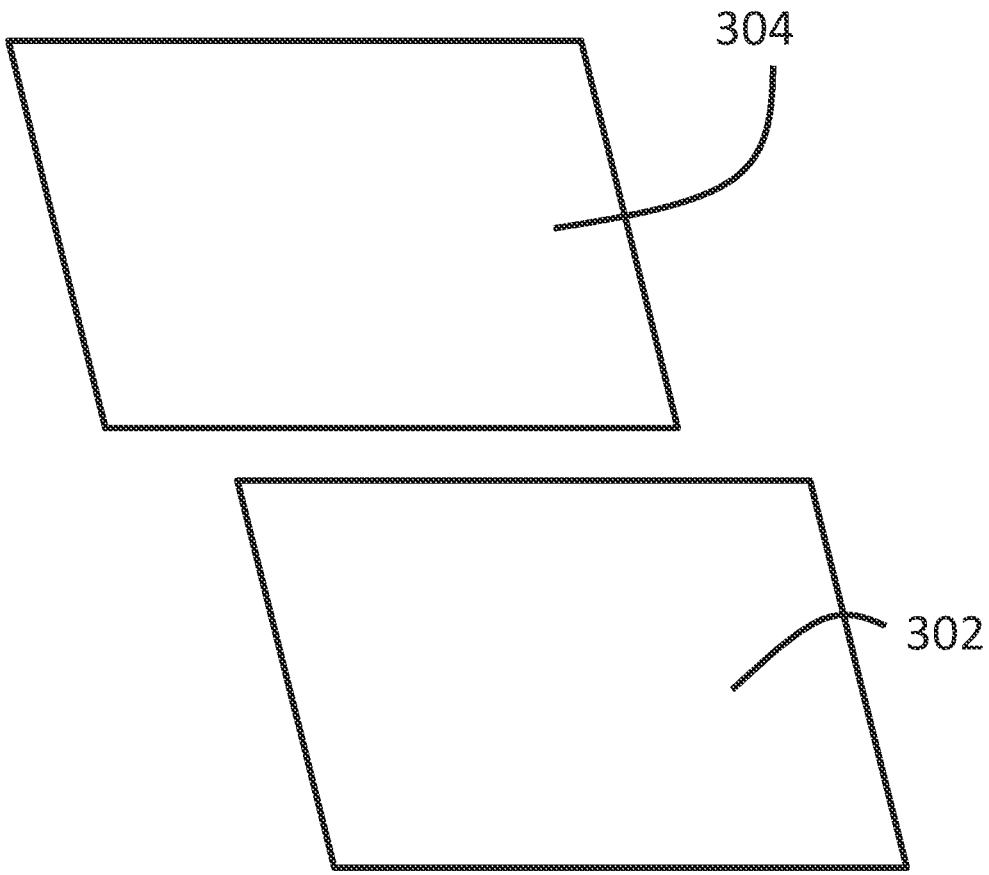
FIGS. 5A-5I are schematic views illustrating exemplary steps for constructing an exemplary waistband having an exemplary drawstring tunnel in accordance with another exemplary embodiment of the present invention.

Referring now to FIGS. 5A-5I, there is shown a method for constructing a waistband according to another exemplary embodiment of the invention. According to some embodiments, the method shown in FIG. 5A-5I may be used to construct a waistband having a tunnel for a drawstring. FIG. 5A illustrates a first fabric 302 and a second fabric 304 being provided which may be used to construct the waistband. In some embodiments, first fabric 302 will form an inside portion of the waistband intended to face towards a person's body when worn, and second fabric 304 will form an outside portion of the waistband intended to face away from the person's body when worn. In some embodiments, first fabric 302 and second fabric 304 may be the same material or different materials. In some embodiments, each of first fabric 302 and second fabric 304 is a synthetic fabric as described herein (e.g., polyester, spandex, rayon, nylon, acrylic, etc.).

Figure 5B:
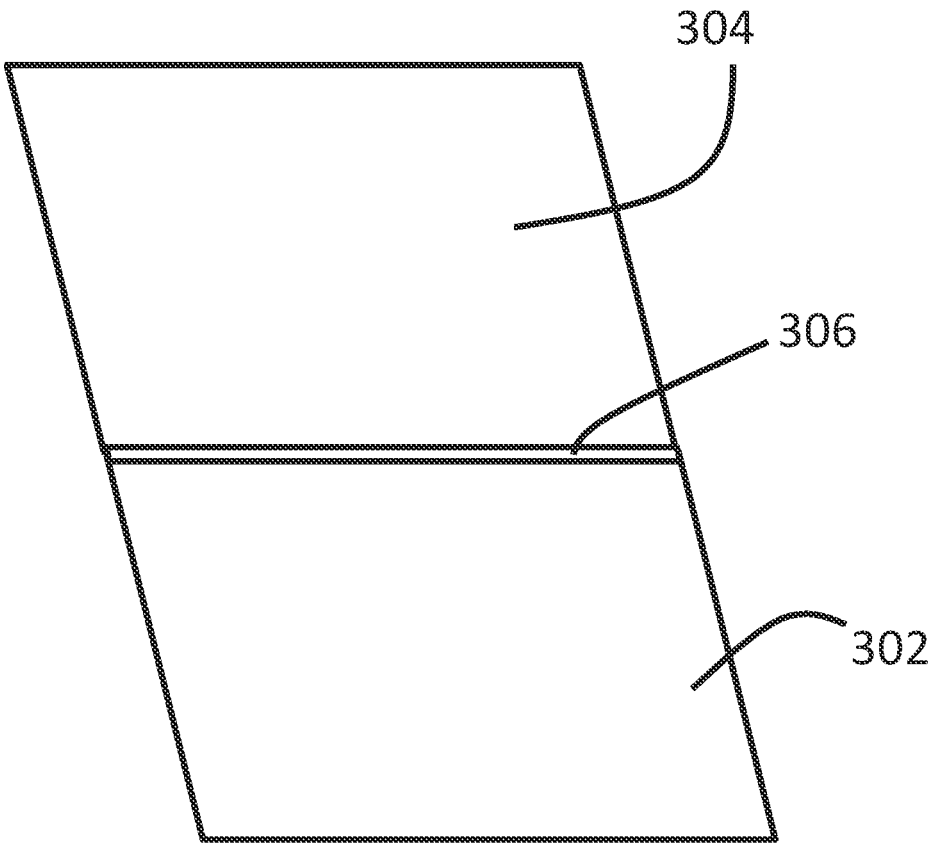

As illustrated in FIG. 5B, first fabric 302 is joined to second fabric 304 in some embodiments. In some embodiments first fabric 302 is joined to second fabric 304 by a seam 306. Seam 306, in some embodiments, may be formed between and extend along an edge of first fabric 302 and an edge of second fabric 304. In some embodiments, seam 306 extends an entire length of first fabric 302 and/or second fabric 304. In certain embodiments, seam 306 is a stitch-free seam which does not include or require any stitching or sewing. In some such embodiments, seam 306 is formed by bonding or welding first fabric 302 with second fabric 304 using, for example, heat, adhesives, and/or ultrasonic energy. In some embodiments, seam 306 is an ultrasonic line bonded (USLB) seam.

Figure 5C:
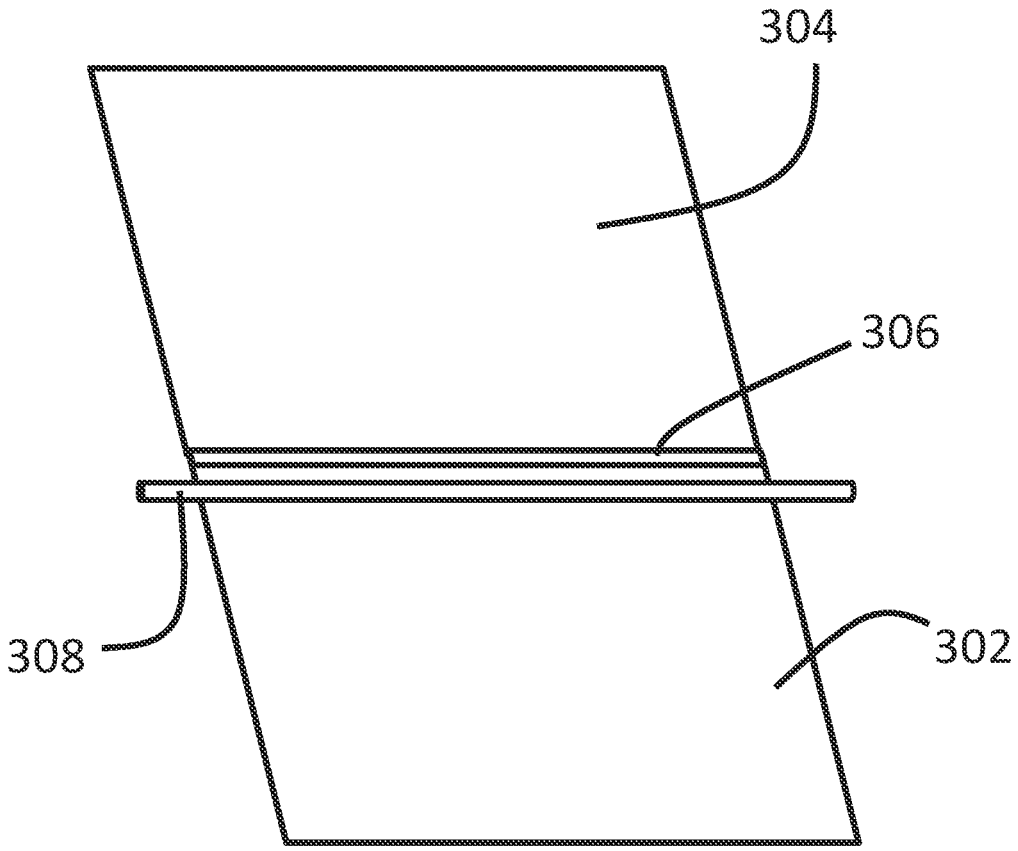

FIG. 5C illustrates a drawstring 308 that is provided and positioned over first fabric 302 and generally parallel to seam 306. Drawstring 308, for example, may be any type of string, cord, lace, rope, etc. which is suitable for drawing a waistband into a tighter fit. In some embodiments, drawstring 308 may include two or more separate strings which are arranged generally in parallel. In some embodiments, drawstring 308 is spaced slightly away from seam 306, as shown. For example, in some embodiments, drawstring 308 is spaced about 0.3 cm away from seam 306.

Figure 5D:
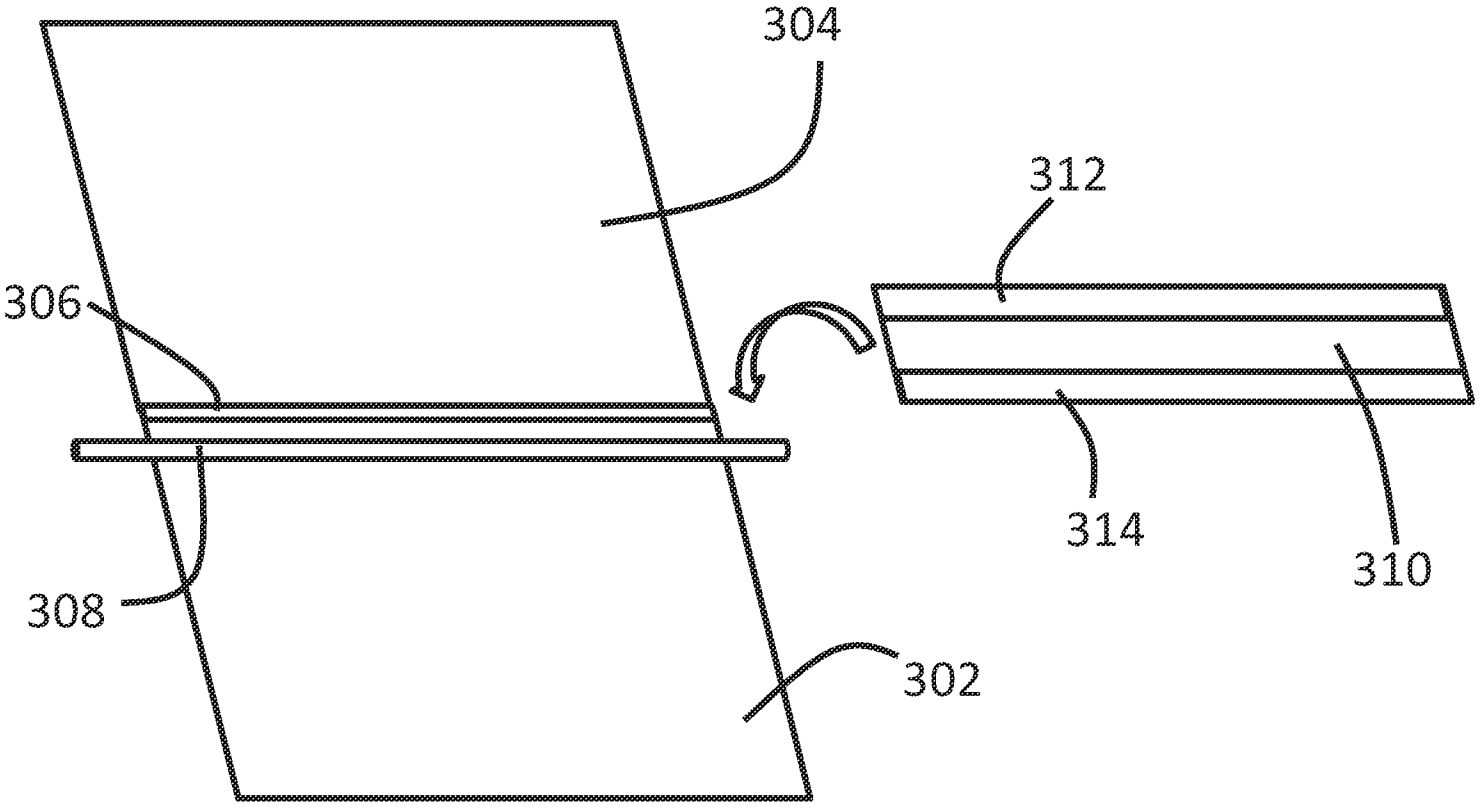

As shown in FIG. 5D, a layer of mesh 310 is provided according to some embodiments. Mesh 310 may be selected, for example, from any of the mesh materials described herein. In some embodiments, one side of mesh 310 is provided with a first adhesive strip 312 and a second adhesive strip 314. First and second adhesive strips 312, 314, in some embodiments, are spaced apart and may be positioned generally parallel to each other on mesh 310. In some embodiments, first adhesive strip 312 includes a strip of adhesive material that is wider than second adhesive strip 314. First adhesive strip 312 may include, for example, an approximately 1.0 cm wide strip of adhesive material which is positioned along a lengthwise edge of mesh 310. Second adhesive strip 314 may include, for example, an approximately 0.6 cm wide strip of adhesive material which is parallel to and spaced apart from first adhesive strip 312 by a distance large enough to accommodate, for example, the diameter of drawstring 308. The adhesive material used for second adhesive strip 314 may be the same adhesive material used for first adhesive strip 312.

Figure 5E:
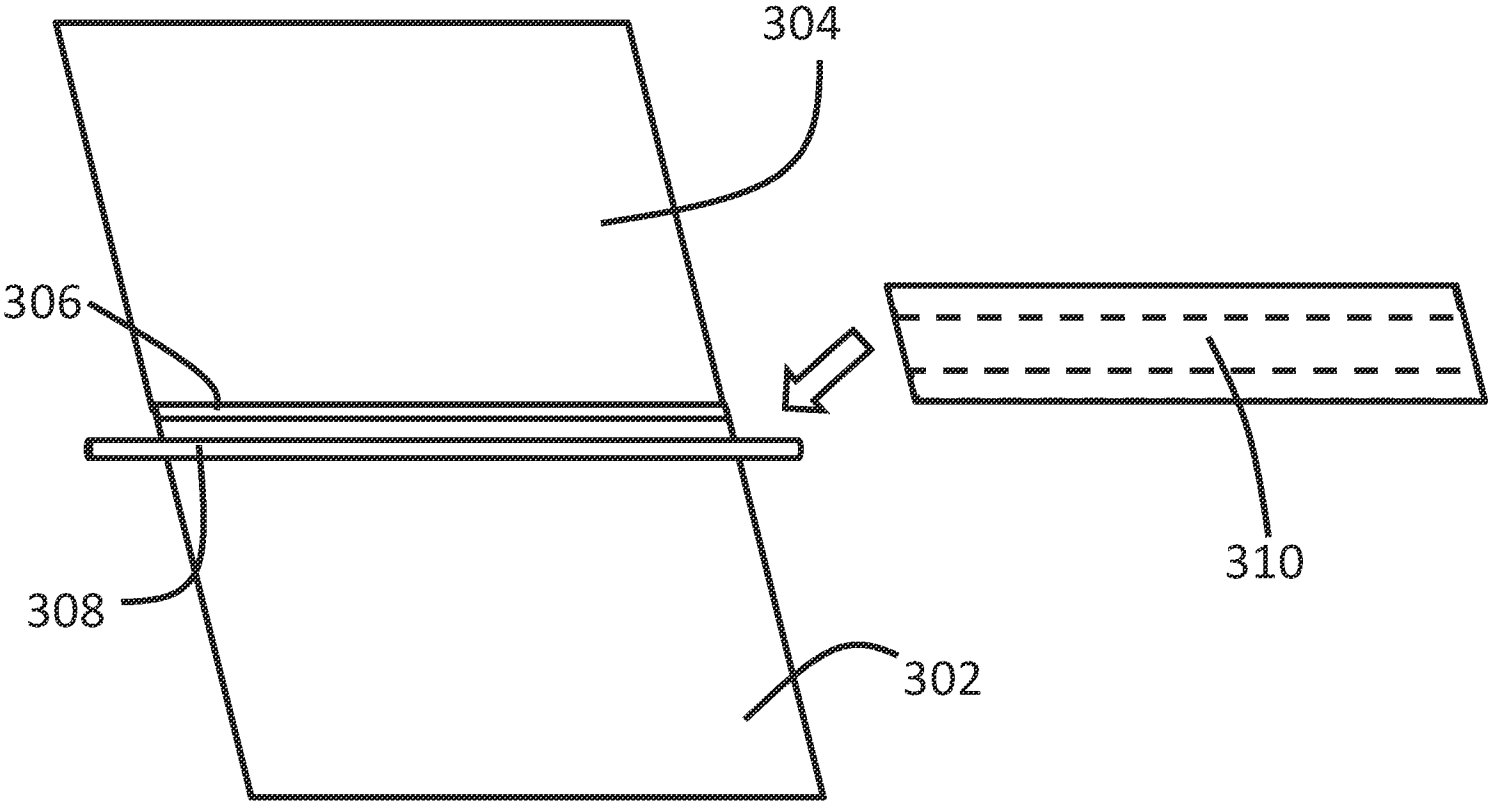
Figure 5F:
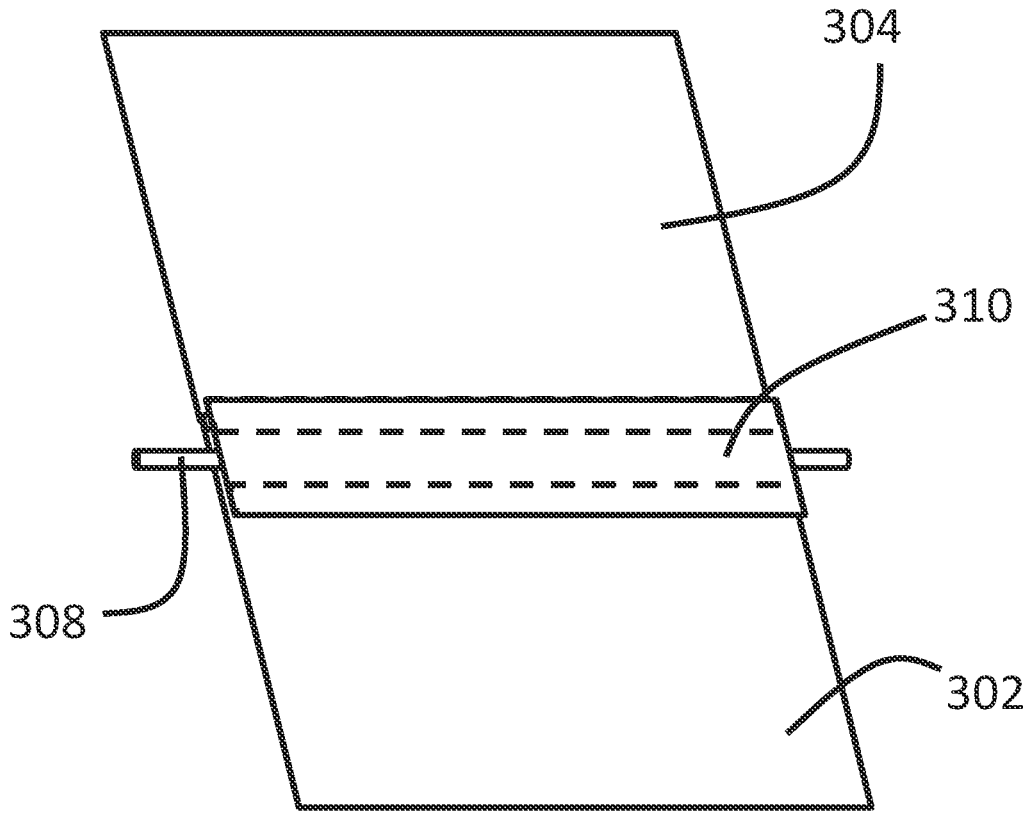

In some embodiments, mesh 310 may be coupled to the joined first fabric 302 and second fabric 304, as generally shown in FIGS. 5E and 5F. In some such embodiments, mesh 310 is positioned such that first adhesive strip 312 on mesh 310 faces and overlays seam 306 and a portion of second fabric 304 that is adjacent to seam 306. For example, in some embodiments, first adhesive strip 312 is sized and positioned to overlay an approximately 0.6 cm wide portion of second fabric 304 adjacent to seam 306. Meanwhile, in some embodiments, second adhesive strip 314 on mesh 310 is positioned to overlay a portion of first fabric 302 below drawstring 308, such that drawstring 308 is positioned between first fabric 302 and a portion of mesh 310 between first and second adhesive strips 312, 314. Accordingly, in some embodiments, first adhesive layer 312 and second adhesive layer 314 adhere mesh 310 to first and second fabrics 302, 304 while also defining a tunnel for drawstring 308.

Figure 5G:
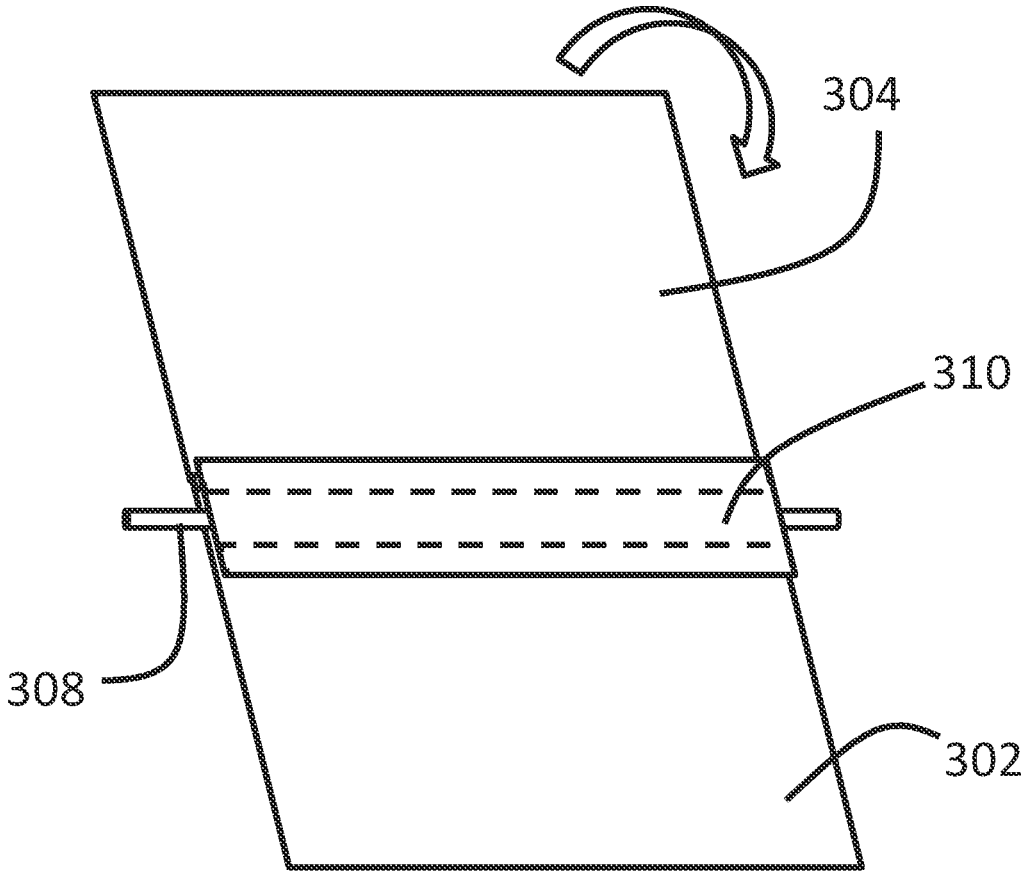
Figure 5H:
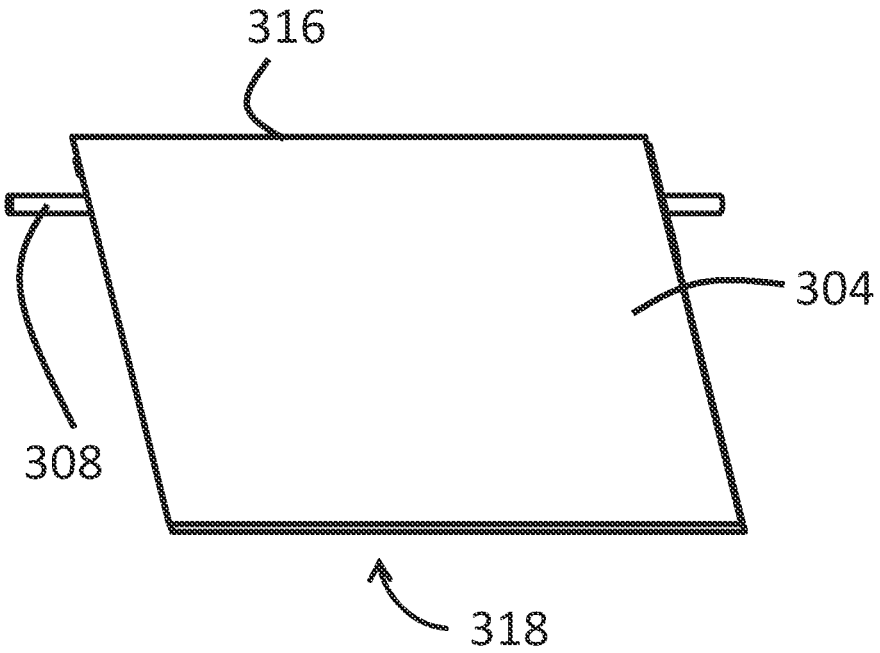
Figure 5I:
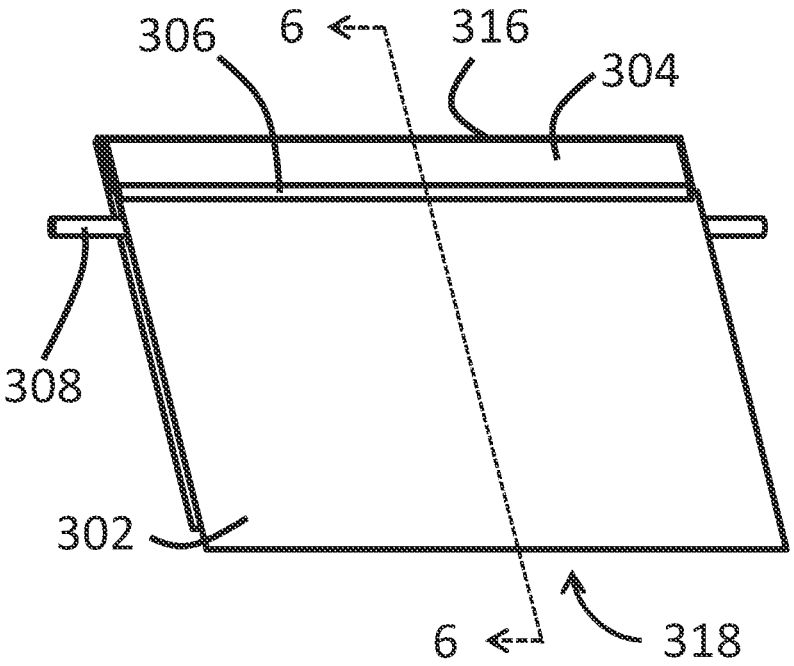

As shown in FIG. 5G, a portion of second fabric 304 may be folded over mesh 310, resulting in a configuration such as that depicted in FIG. 511, where fold 316 in fabric 304 forms a top edge of the waistband. A bottom portion 318 of the waistband, which is opposite of fold 316, in some embodiments may be attached to additional materials that will be used to form the remainder of the article of clothing, e.g., by sewing, stitching, or other known methods. In particular, FIG. 511 shows a first side of the resulting waistband construction according to certain embodiments, which is formed mostly or entirely from second fabric 304. In some embodiments, the first side shown in FIG. 511 represents an exterior side of the waistband that is intended to face away from the wearer's body. An opposite, second side of the resulting waistband construction is shown in FIG. 5I, which may represent an interior side of the waistband that is intended to face toward the wearer's body. In particular, the second side of the waistband construction, in some embodiments, includes first fabric 302, seam 306, and a portion of second fabric 304. In some such embodiments, seam 306 can therefore be hidden from view, which may be desirable for aesthetic reasons.

FIG. 6 shows a cross-sectional view of the waistband construction taken along the plane depicted by line 6-6 in FIG. 5I. As shown, mesh 310 is sandwiched between first fabric 302 and folded second fabric 304 and is secured thereto by first and/or second adhesive strips 312, 314. Drawstring 308, as shown, is positioned between first fabric 302 and a portion of mesh 310 situated between first and second adhesive strips 312, 314. Thus, in some embodiments, a drawstring tunnel is created in the interior of the waistband between first fabric 302 and mesh 310. It should be appreciated that, in some embodiments, at least a portion of drawstring 308 may move relative to (e.g. slide within) the drawstring tunnel in order to tighten/loosen the waistband during use. In some embodiments, fold 316, where second fabric 304 is folded over mesh 310, forms a top edge of the waistband construction. The opposite bottom portion 318 of the waistband may be connected to the remainder of the article of clothing (e.g., pant legs, skirt, etc.), for example, by sewing, stitching, or other known methods. In some embodiments, first fabric 302 and second fabric 304, may be sewn, stitched, or otherwise attached together at bottom portion 318.

Referring now to FIGS. 7A-7H, there is shown a method for constructing a waistband according to another exemplary embodiment of the invention. According to some embodiments, the method shown in FIG. 7A-7H may be used to construct a waistband having a tunnel for a drawstring as well as one or more pockets. FIG. 7A illustrates a first fabric 402 and a second fabric 404 being provided which may be used to construct the waistband. In some embodiments, first fabric 402 will form an inside portion of the waistband intended to face towards a person's body when worn, and second fabric 404 will form an outside portion of the waistband intended to face away from the person's body when worn. In some embodiments, first fabric 402 and second fabric 404 may be the same material or different materials. In some embodiments, each of first fabric 402 and second fabric 404 is a synthetic fabric as described herein (e.g., polyester, spandex, rayon, nylon, acrylic, etc.).

In some embodiments, first fabric 402 may include one or more cutouts or openings. For example, in the illustrated embodiment first fabric includes at least a first opening 406*a* and, in some embodiments, further includes at least a second opening 406*b*. First and second openings 406*a*, 406*b* may each be in the form of an elongated slot according to some embodiments, and are configured to be the openings of separate pockets formed in the waistband. In some embodiments, for example, first opening 406*a* and/or second opening 406*b* may have a length of about 8.5 cm to about 10.0 cm and a width of about 0.2 cm to about 0.6 cm. In some embodiments, first opening 406*a* and second opening 406*b* may be spaced apart from each other and, in certain embodiments, may be differently shaped, sized, or angled. In some embodiments, each of first opening 406*a* and second opening 406*b* may be spaced away from an edge of first fabric 402 (e.g., a top lengthwise edge) by about 3.0 cm to about 5.0 cm. In certain embodiments, first fabric 402 also includes drawstring holes 408*a*, 408*b*, which are sized and configured to receive a drawstring and provide openings to a drawstring tunnel in the waistband. Each drawstring hole 408*a*, 408*b*, for example, may include an opening having dimensions of about 0.2 cm×about 0.6 cm. In some embodiments, drawstring holes 408*a*, 408*b* may be spaced apart by about 2.5 cm to about 4.0 cm.

First and second openings 406*a*, 406*b* and drawstring holes 408*a*, 408*b*, may be formed by any suitable method. In some particular embodiments, first and second openings 406*a*, 406*b* and/or drawstring holes 408*a*, 408*b*, are cut into first fabric 402 by a laser. In further embodiments, each or some of first and second openings 406*a*, 406*b* and drawstring holes 408*a*, 408*b* may be bordered by a reinforcement to prevent fraying of the adjacent fabric material The reinforcement may provide, for example, a border around each opening/hole that is about 2.1 mm to about 2.4 mm wide.

As illustrated in FIG. 7B, first fabric 402 is joined to second fabric 404 in some embodiments. In some embodiments first fabric 402 is joined to second fabric 404 by a seam 410. Seam 410, in some embodiments, may be formed between and extend along an edge of first fabric 402 (e.g., a bottom lengthwise edge) and an edge of second fabric 404 (e.g., a top lengthwise edge). In some embodiments, seam 410 extends an entire length of first fabric 402 and/or second fabric 404. In certain embodiments, seam 410 is a stitch-free seam which does not include or require any stitching or sewing. In some such embodiments, seam 410 is formed by bonding or welding first fabric 402 with second fabric 404 using, for example, heat, adhesives, and/or ultrasonic energy. In some embodiments, seam 410 is an ultrasonic line bonded (USLB) seam.

In some embodiments, a first adhesive layer 414 may be applied, as illustrated in FIG. 7C. The first adhesive layer 414 may include, for example, an approximately 1.0 cm wide strip of adhesive material and, in some embodiments, is applied onto over seam 410. In some embodiments, first adhesive layer 414 may be applied along the entire length of seam 410. As further shown in FIG. 7C, in some embodiments, a drawstring 412 may be threaded through drawstring holes 408*a*, 408*b*. Drawstring 412 may be configured similarly to drawstring 308 described previously. In some embodiments, drawstring 412 is arranged generally parallel to seam 410.

As shown in FIG. 7D, a layer of mesh 416 is provided according to some embodiments. Mesh 416 may be selected, for example, from any of the mesh materials described herein. In some embodiments, one side of mesh 416 is provided with a first adhesive strip 418 and a second adhesive strip 420. First and second adhesive strips 418, 420 in some embodiments, are spaced apart and may be positioned generally parallel to each other on mesh 416. In some embodiments, first adhesive strip 418 includes a strip of adhesive material that is wider than second adhesive strip 420. In other embodiments, first adhesive strip 418 includes a strip of adhesive material that has the same width as second adhesive strip 420. First adhesive strip 418 may include, for example, an approximately 0.6 cm wide strip of adhesive material which is positioned along a lengthwise edge of mesh 416. Second adhesive strip 420 may include, for example, an approximately 0.6 cm wide strip of adhesive material which is parallel to and spaced apart from first adhesive strip 418 by a distance large enough to accommodate, for example, the diameter of drawstring 412. The adhesive material used for second adhesive strip 420 may be the same adhesive material used for first adhesive strip 418.

In some embodiments, mesh 416 may further include one or at least two pocket regions 422, 428, which are configured to form inner walls of the pockets of the waistband. Pocket regions 422, 428, in some embodiments, have dimensions such that the resulting pockets are large enough to hold coins, credit cards, keys, medicines, mobile telephones, or other small personal items. For example, in some embodiments, pocket regions 422, 428 may have a dimension (e.g., length, width, or height) that is about or at least 10 cm. In some embodiments, pocket region 422 may be spaced apart from pocket region 428. In some embodiments, pocket region 422 may be spaced apart from pocket region 428 by an opening or gap in the mesh material between pocket region 422 and pocket region 428. In some embodiments, each pocket region 422, 428 are bordered by additional adhesive strips. For example, as illustrated, pocket region 422 is at least partially bordered by adhesive strips 424 and 426. Pocket region 428 is at least partially bordered by adhesive strips 430 and 432. In further embodiments, each of pocket region 422 and 428 is also bordered by second adhesive strip 420. In some embodiments, adhesive strips 424, 426, 430, 432 each may extend generally perpendicular to second adhesive strip 420. In further embodiments, adhesive strips 424, 426, 430, 432 each may be, for example, approximately 1.0 cm wide.

Figure 7F:
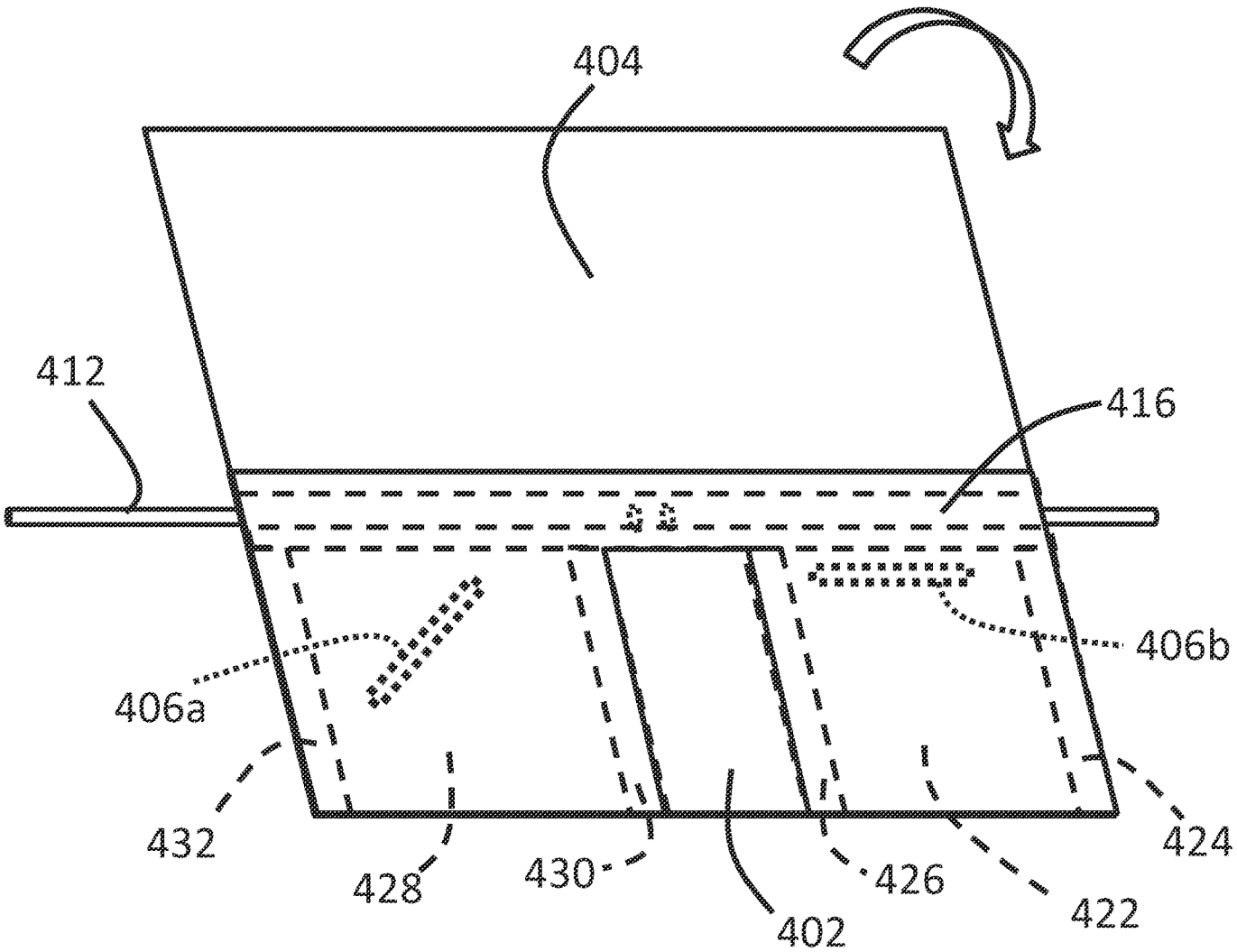

In some embodiments, mesh 416 may be coupled to the joined first fabric 402 and second fabric 404, as generally shown in FIGS. 7E and 7F. In some such embodiments, mesh 416 is positioned such that first adhesive strip 418 on mesh 416 faces and overlays first adhesive layer 414 Meanwhile, in some embodiments, second adhesive strip 420 on mesh 416 is positioned to overlay a portion of first fabric 402 below drawstring 412, such that drawstring 412 is positioned between first fabric 402 and a portion of mesh 416 between first and second adhesive strips 418, 420. Accordingly, in some embodiments, first adhesive strip 418 and second adhesive strip 420 are configured to adhere mesh 416 to first and second fabrics 402, 404 while also defining a tunnel for drawstring 412.

Moreover, in some embodiments, a remainder of mesh 416, including pocket regions 422, 428 and adhesive strips 424, 426, 430, 432, may be positioned to overlay portions of first fabric 402. In particular, in some embodiments, pocket region 428 is positioned to overlay a portion of first fabric 402 that includes first opening 406*a*, and pocket region 422 is positioned to overlay a portion of first fabric 402 that includes second opening 406*b*. First and second openings 406*a*, 406*b* are therefore positioned to communicate with the interior spaces of the pockets formed between first fabric 402 and pocket regions 428 and 422, respectively. Additionally, in some embodiments, mesh 416 is adhered to first fabric 402 by adhesive strips 424, 426, 430, 432, which define the sides of the pockets formed between first fabric 402 and pocket regions 422 and 428 of mesh 416.

Figure 7G:
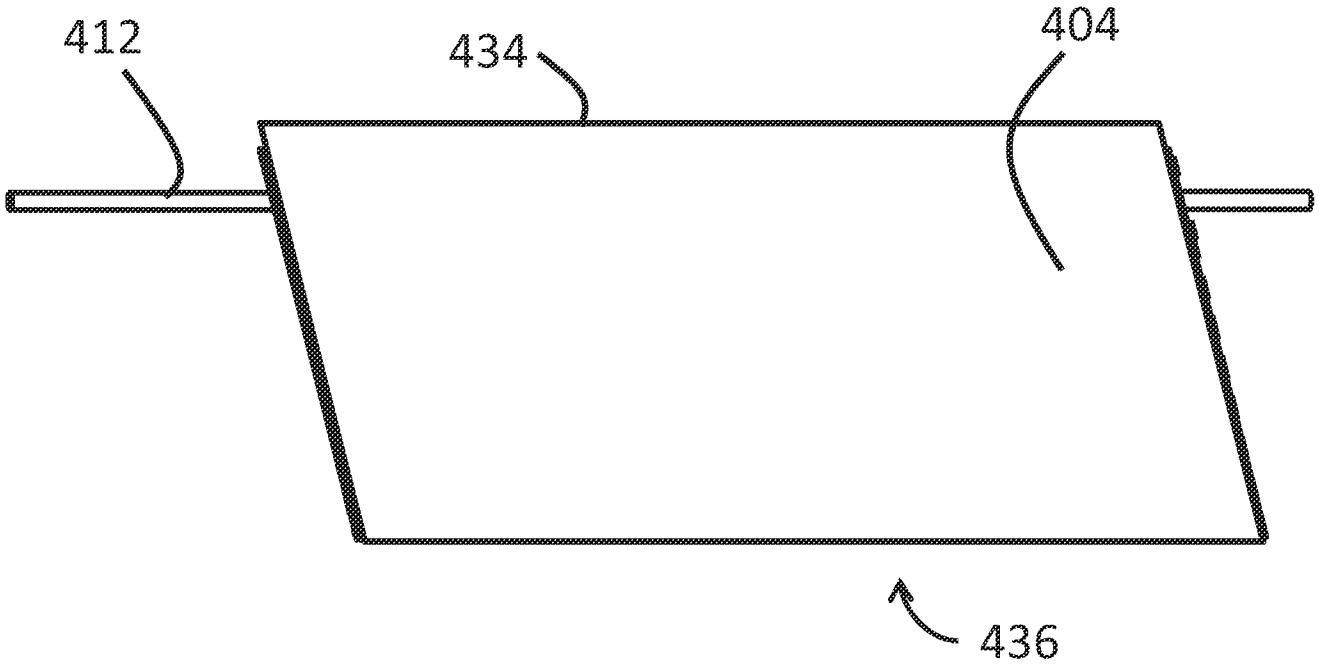

As further shown in FIG. 7F, a portion of second fabric 404 may be folded over mesh 416, resulting in a configuration such as that depicted in FIG. 7G, where fold 434 in fabric 404 forms a top edge of the waistband. A bottom portion 436 of the waistband, which is opposite of fold 434, in some embodiments may be attached to additional materials that will be used to form the remainder of the article of clothing, e.g., by sewing, stitching, or other known methods. In particular, FIG. 7G shows a first side of the resulting waistband construction according to certain embodiments, which is formed mostly or entirely from second fabric 404. In some embodiments, the first side shown in FIG. 7G represents an exterior side of the waistband that is intended to face away from the wearer's body. An opposite, second side of the resulting waistband construction is shown in FIG. 7H, which may represent an interior side of the waistband that is intended to face toward the wearer's body. In particular, the second side of the waistband construction, in some embodiments, includes first fabric 402, seam 410, and a portion of second fabric 404. Furthermore, first and second openings 406*a*, 406*b*, which provide access to the interior pockets of the waistband, are positioned on and accessible through the second side of the waistband, as shown. In some such embodiments, seam 410 and first and second openings 406*a*, 406*b* can therefore be hidden from view, which may be desirable for aesthetic reasons. Furthermore, hiding first and second openings 406*a*, 406*b* on the interior side of the waistband may provide added security to the contents held in the pockets. As further shown in FIG. 7H, a portion of drawstring 412 may extend from drawstring holes 408*a*, 408*b* and be accessible from the second side of the waistband which, for example, allows the wearer to pull or loosen drawstring 412 to adjust the fit of the waistband.

FIG. 8A shows a cross-sectional view of the waistband construction taken along the plane depicted by line 8A-8A in FIG. 7H, and FIG. 8B shows a cross-sectional view of the waistband construction taken along the plane depicted by line 8B-8B in FIG. 7H. As shown, mesh 416 is sandwiched between first fabric 402 and folded second fabric 404 and is secured thereto by first adhesive layer 414 and first and/or second adhesive strips 418, 420. Drawstring 412, as shown, is positioned between first fabric 402 and a portion of mesh 416 situated between first and second adhesive strips 418, 420. Thus, in some embodiments, a drawstring tunnel is created in the interior of the waistband between first fabric 402 and mesh 416. It should be appreciated that, in some embodiments, at least a portion of drawstring 412 may move relative to (e.g. slide within) the drawstring tunnel in order to tighten/loosen the waistband during use. In some embodiments, fold 434, where second fabric 404 is folded over mesh 416, forms a top edge of the waistband construction. The opposite bottom portion 436 of the waistband may be connected to the remainder of the article of clothing (e.g., pant legs, skirt, etc.), for example, by sewing, stitching, or other known methods. In some embodiments, first fabric 402 and second fabric 404, may be sewn, stitched, or otherwise attached together at bottom portion 436. As further shown in FIG. 8B, opening 406*b*, located on a portion of first fabric 402, connects to and provides access to interior space 438 of the pocket formed between first fabric 402 and pocket region 422 of mesh 416. Opening 406*b* and interior space 438 may be sized, for example, to receive and hold coins, credit cards, keys, medicines, mobile telephones, or other small personal items. Furthermore, as described previously, opening 406*b* may be bordered by a reinforcing material 440 which is configured to prevent fraying of the fabric material surrounding opening 406*b*.

It should be noted that the specific sequences described herein are not necessarily in order. For instance, the first adhesive layer can be but not necessarily have to be applied before the second adhesive layer. Instead, the first adhesive layer and the second adhesive layer can be applied in any suitable order, sequentially or concurrently. As an example, in an embodiment, the second adhesive layer can be applied before the first adhesive layer is applied. In another embodiment, the first and second adhesive layers are applied together to adhere the mesh layer with the inner fabric layer.

In a further embodiment, both of the first and second adhesive layers are applied to the mesh layer (in any order) and then the mesh layer with the adhesive layers are applied to the inner layer.

Further, it should be noted that, although the terms "first," "second," etc. may be used herein to describe various elements, these elements should not be limited by these terms. These terms are only used to distinguish one element from another. For example, a first adhesive layer could be termed a second adhesive layer, and, similarly, a second adhesive layer could be termed a first adhesive layer, without changing the meaning of the description, so long as all occurrences of the "first adhesive layer" are renamed consistently and all occurrences of the "second adhesive layer" are renamed consistently.

REFERENCES CITED AND ALTERNATIVE EMBODIMENTS

All references cited herein are incorporated herein by reference in their entirety and for all purposes to the same extent as if each individual publication or patent or patent application was specifically and individually indicated to be incorporated by reference in its entirety for all purposes.

Many modifications and variations of this invention can be made without departing from its spirit and scope, as will be apparent to those skilled in the art. The specific embodiments described herein are offered by way of example only. The embodiments were chosen and described in order to best explain the principles of the invention and its practical applications, to thereby enable others skilled in the art to best utilize the invention and various embodiments with various modifications as are suited to the particular use contemplated. The invention is to be limited only by the terms of the appended claims, along with the full scope of equivalents to which such claims are entitled.

What is claimed is:

1. A waistband of an article of clothing, comprising:

an inner fabric layer;

an outer fabric layer integrally formed or coupled with the inner fabric layer;

a mesh layer disposed between the inner and outer fabric layers; and a first adhesive layer and a second adhesive layer disposed longitudinally between the mesh layer and the inner fabric layer, the first adhesive layer and the second adhesive layer collectively configured to couple the mesh layer with the inner fabric layer, wherein:

(i) an upper region of the waistband comprises the inner fabric layer, the first adhesive layer, the second adhesive layer, the mesh layer and the outer fabric layer, wherein a first portion of the first adhesive layer overlies a second portion of the second adhesive layer;

(ii) a middle region of the waistband comprises the inner fabric layer, the second adhesive layer, the mesh layer and the outer fabric layer; and (iii) a lower region of the waistband comprises the inner fabric layer, the mesh layer and the outer fabric layer, wherein:

the inner fabric layer comprises a first fabric and a first portion of a second fabric; and the outer fabric layer comprises a second portion of the second fabric, wherein the first fabric comprises a first portion having a first edge, and the first portion of the second fabric comprises a second edge, wherein the first edge of the first portion of the first fabric and the second edge of the first portion of the second fabric are joined with each other and form a stitch-free seam.

2. The waistband of claim 1, wherein the first adhesive layer is disposed between the inner fabric layer and the second adhesive layer.

3. The waistband of claim 1, wherein when worn, the inner fabric layer faces toward a wearer's body and the outer fabric layer faces away from the wearer's body.

4. The waistband of claim 1, wherein the outer fabric layer extends to a portion or an entire length of the waistband.

* * * * *